US007174110B2

(12) United States Patent
Soga et al.

(10) Patent No.: US 7,174,110 B2
(45) Date of Patent: Feb. 6, 2007

(54) IMAGE FORMING DEVICE HAVING REPLACEMENT UNITS MOUNTED THERETO

(75) Inventors: Hiroh Soga, Saitama (JP); Kiyoshi Nagamine, Saitama (JP); Hiroshi Kawarazuka, Saitama (JP); Hideaki Tanaka, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 55 days.

(21) Appl. No.: 11/022,989

(22) Filed: Dec. 28, 2004

(65) Prior Publication Data

US 2005/0254831 A1 Nov. 17, 2005

(30) Foreign Application Priority Data

May 17, 2004 (JP) ..... P.2004-146138
May 17, 2004 (JP) ..... P.2004-146139

(51) Int. Cl.
*G03G 15/00* (2006.01)

(52) U.S. Cl. ..... 399/12; 399/27; 399/111; 399/81

(58) Field of Classification Search ..... 399/12, 399/13, 24–27, 31, 44, 82, 85, 81
See application file for complete search history.

(56) References Cited

U.S. PATENT DOCUMENTS

2003/0063914 A1* 4/2003 Masuda et al. ..... 399/12

FOREIGN PATENT DOCUMENTS

| | | | |
|---|---|---|---|
| JP | 06-169051 | A | 6/1994 |
| JP | 2602341 | B2 | 1/1997 |
| JP | 10-133528 | A | 5/1998 |
| JP | 2001-100598 | A | 4/2001 |
| JP | 3476704 | B2 | 9/2003 |

* cited by examiner

*Primary Examiner*—Hoang Ngo
(74) *Attorney, Agent, or Firm*—Oliff & Berridge, PLC

(57) ABSTRACT

With an image forming device, with respect to a set image density S (default mode), the modes of: increasing or decreasing the variation amount (slope) of the set image density in accordance with a usage amount of a developing device (m1, m2); increasing or decreasing the limit value (m1, m2); changing the initial value (usage amount=0); not changing the setting in accordance with the usage amount (m4); and changing, for example, the initial value but not changing the setting in accordance with the usage amount (m5); etc., are provided as operation modes that differ from an operation mode accommodating a genuine product and are enabled to be selected by a user when a toner cartridge containing a toner that is a product other than a genuine product is mounted.

13 Claims, 32 Drawing Sheets

IMAGE FORMING DEVICE HAVING REPLACEMENT UNITS MOUNTED THERETO

BACKGROUND OF THE INVENTION

1. Field of the Invention

This invention relates to an image forming device, and more specifically relates to an image forming device, with which replacement units are replaceably mounted to a main device body.

2. Background Art

There are known image forming devices, with which consumables and other units can be replaced readily by a user.

Meanwhile, when a unit that is replaced by the user is a product other than a genuine product for the image forming device, problems, such as the lowering of the image quality and other cases of inadequate exhibition of the performance of the image forming device, the inability to guarantee operations, and malfunctions, etc., may occur. This is because an image forming device controls the image forming process in consideration of the characteristics of the toner, the characteristics of the image carrying body, the charging voltage, the cleaning characteristics, the fixing characteristics, etc.

For maintaining the image quality of an image forming device and preventing problems, JP-A-10-133528 discloses a method wherein a genuine replacement part is provided with a data carrier, which holds consumption amount data of a consumable, and whether or not the consumable has been supplied to the genuine replacement part is judged by comparing the consumption amount detected by a consumption amount detection part provided in a main device body and the consumption amount data held by the data carrier.

Also, JP-A-6-149051 discloses a method wherein a toner cartridge is provided with a storage unit that stores predetermined code data and copying is prohibited when the main body of a copier cannot read the predetermined code data from the storage unit.

Also, JP-A-2001-100598 discloses a method wherein, when empty information, which is written into a cartridge when the running out of toner is detected, is read from a cartridge to which toner has been replenished, a warning indication is displayed and printing is prohibited.

Also, Japanese Patent No. 2602341 discloses a method wherein the count of images prepared is stored in a memory of a cartridge and the cartridge is prevented from further use when a preset end count, which expresses the number of images that can be prepared by the cartridge, becomes equal to the count of the images prepared.

Furthermore, Japanese Patent No. 3476704 discloses a method wherein, when by bidirectional communication between a container side communication unit of a toner supplying container and a main body side communication unit of a main device body, it is judged that a toner supplying container that has been mounted is incompatible and it is selected by a selection inputting unit that a supplying process is to be continued with the incompatibility being ignored, image forming conditions that are lower in level than appropriate image forming conditions are set to enable the incompatibility of the toner supplying container to be discovered more readily.

SUMMARY OF THE INVENTION

A first object of this invention is to provide an image forming device, with which, even when a replacement unit that is a product other than a genuine product is mounted, the replacement unit that is a product other than a genuine product can be used in accordance with the will of a user. A second object of this invention is to provide an image forming device, with which, even when a replacement unit that is a product other than a genuine product is mounted, control under an operation mode that accommodates a product other than a genuine product is enabled.

In order to achieve the above object, a first aspect of the invention provides an image forming device including: a main device body; at least one replacement unit, mounted replaceably to the main device body; a judging unit, judging whether the replacement unit is a genuine product or is a product other than a genuine product; an input unit, for selecting among an operation mode, accommodating a replacement unit that is a genuine product, and other operation modes that differ from the abovementioned operation mode; a correction unit, correcting image forming conditions in accordance with usage amounts related to image formation; and a correction amount changing unit, changing the amounts of correction by the abovementioned correction unit in accordance with the operation mode selected by the abovementioned input unit. A user can thus select among an operation mode that accommodates a replacement unit that is a genuine product and other operation modes, and the amounts of correction by the correction unit can be changed in accordance with the operation mode selected by the input unit in accordance with the will of the user to enable use of a replacement unit that is a product other than a genuine product.

Here, "operation mode" refers to the mode of control of the image forming device and this includes not only the program and control parameters for image formation but also include input conditions and output conditions and furthermore modes of display on a display device that is not directly related to image formation.

Preferably, the abovementioned correction amount changing unit includes at least one among an initial setting value changing unit, changing initial setting values of the image forming conditions corrected by the abovementioned correction unit, and a correction amount zeroing unit, making the amounts of correction of the image forming conditions by the abovementioned correction unit substantially zero. A user is thus enabled to select at least one among changing the initial setting values of the image forming conditions corrected by the correction unit and making the amounts of correction of the image forming condition substantially zero, and the amounts of correction by the correction unit can be changed in accordance with the operation mode selected by the input unit in accordance with the will of the user to enable use of a replacement unit that is a product other than a genuine product.

Preferably, the operation mode, accommodating a replacement unit that is a genuine product, is set as a default. Thus when the replacement unit is a genuine product, since the operation mode accommodating the replacement unit that is a genuine product is set as the default, a user can readily use the image forming device in the operation mode accommodating the replacement unit that is a genuine product.

Preferably, a detection unit, detecting that the abovementioned replacement unit has been replaced, is furthermore equipped and the abovementioned correction amount changing unit changes the amounts of correction by the abovementioned correction unit in accordance with the operation mode selected by the abovementioned input unit when the abovementioned detection unit detects that the abovementioned replacement unit has been replaced. Since a user can thus select the operation mode by the input unit when the replacement unit is replaced, the use of a replacement unit that is a product other than a genuine product is enabled in accordance with the will of the user.

Preferably, the abovementioned detection unit detects that the abovementioned replacement unit has been replaced at a predetermined timing after the abovementioned replacement unit has been replaced. Thus even in the case where the detection unit cannot detect the replacement unit immediately after replacement of the replacement unit, that the replacement unit has been replaced can be detected at a predetermined timing.

Preferably, when the abovementioned judging unit judges that at least one of the abovementioned replacement units is a product other than a genuine product, the abovementioned correction amount changing unit changes the amounts of correction by the abovementioned correction unit in accordance with the operation mode selected by the abovementioned input unit. That is, in the case where at least one of the replacement units is a product that is other than a genuine product, a user can select the operation mode by means of the input unit so that the use of the replacement unit that is a product other than a genuine product is enabled in accordance with the will of the user.

Further, in order to achieve the above object, a second aspect of the invention provides an image forming device including: a main device body; at least one replacement unit, mounted replaceably to the main device body; a judging unit, judging whether the replacement unit is a genuine product or is a product other than a genuine product; an input unit, for selecting among an operation mode, accommodating a replacement unit that is a genuine product, and other operation modes that differ from the abovementioned operation mode; a detection unit, detecting the environment; a correction unit, correcting image forming conditions in accordance with detection results of the detection unit; and a correction amount changing unit, changing the amounts of correction by the abovementioned correction unit in accordance with the operation mode selected by the abovementioned input unit. A user can thus select among an operation mode that accommodates a replacement unit that is a genuine product and other operation modes, and the amounts of correction by the correction unit can be changed in accordance with the operation mode selected by the input unit in accordance with the will of the user to enable use of a replacement unit other than a genuine product.

Here, "operation mode" refers to the mode of control of the image forming device and this includes not only the program and control parameters for image formation but also include input conditions and output conditions and furthermore modes of display on a display device that is not directly related to image formation.

Preferably, the abovementioned correction amount changing unit includes at least one among an initial setting value changing unit, changing initial setting values of the image forming conditions corrected by the abovementioned correction unit, and a correction amount zeroing unit, making the amounts of correction of the image forming conditions by the abovementioned correction unit substantially zero. A user is thus enabled to select at least one among changing the initial setting values of the image forming conditions corrected by the correction unit and making the amounts of correction of the image forming condition substantially zero, and the amounts of correction by the correction unit can be changed in accordance with the operation mode selected by the input unit in accordance with the will of the user to enable use of a replacement unit that is a product other than a genuine product.

Preferably, the operation mode, accommodating a replacement unit that is a genuine product, is set as a default. Thus when the replacement unit is a genuine product, since the operation mode accommodating the replacement unit that is a genuine product is set as the default, a user can readily use the image forming device in the operation mode accommodating the replacement unit that is a genuine product.

Preferably, a replacement detection unit, detecting that the abovementioned replacement unit has been replaced; is furthermore equipped and the abovementioned correction amount changing unit changes the amounts of correction by the abovementioned correction unit in accordance with the operation mode selected by the abovementioned input unit when the abovementioned replacement detection unit detects that the abovementioned replacement unit has been replaced. Since a user can thus select the operation mode by the input unit when the replacement unit is replaced, the use of a replacement unit other than a genuine product is enabled in accordance with the will of the user.

Preferably, the abovementioned replacement detection unit detects that the abovementioned replacement unit has been replaced at a predetermined timing after the abovementioned replacement unit has been replaced. Thus even in the case where the replacement detection unit cannot detect the replacement unit immediately after replacement of the replacement unit, that the replacement unit has been replaced can be detected at a predetermined timing.

Preferably, when the abovementioned judging unit judges that at least one of the abovementioned replacement units is a product other than a genuine product, the abovementioned correction amount changing unit changes the amounts of correction by the abovementioned correction unit in accordance with the operation mode selected by the abovementioned input unit. That is, in the case where at least one of the replacement units is a product that is other than a genuine product, a user can select the operation mode by means of the input unit so that the use of the replacement unit that is a product other than a genuine product is enabled in accordance with the will of the user.

By this invention, even when a replacement unit that is a product other than a genuine product is mounted, the replacement unit that is a product other than a genuine product can be used in accordance with the will of the user. Also by this invention, even when a replacement unit that is a product other than a genuine product is mounted, control under an operation mode accommodating the product other than a genuine product is enabled.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

An embodiment of this invention shall now be described based on the drawings.

Figure 1:
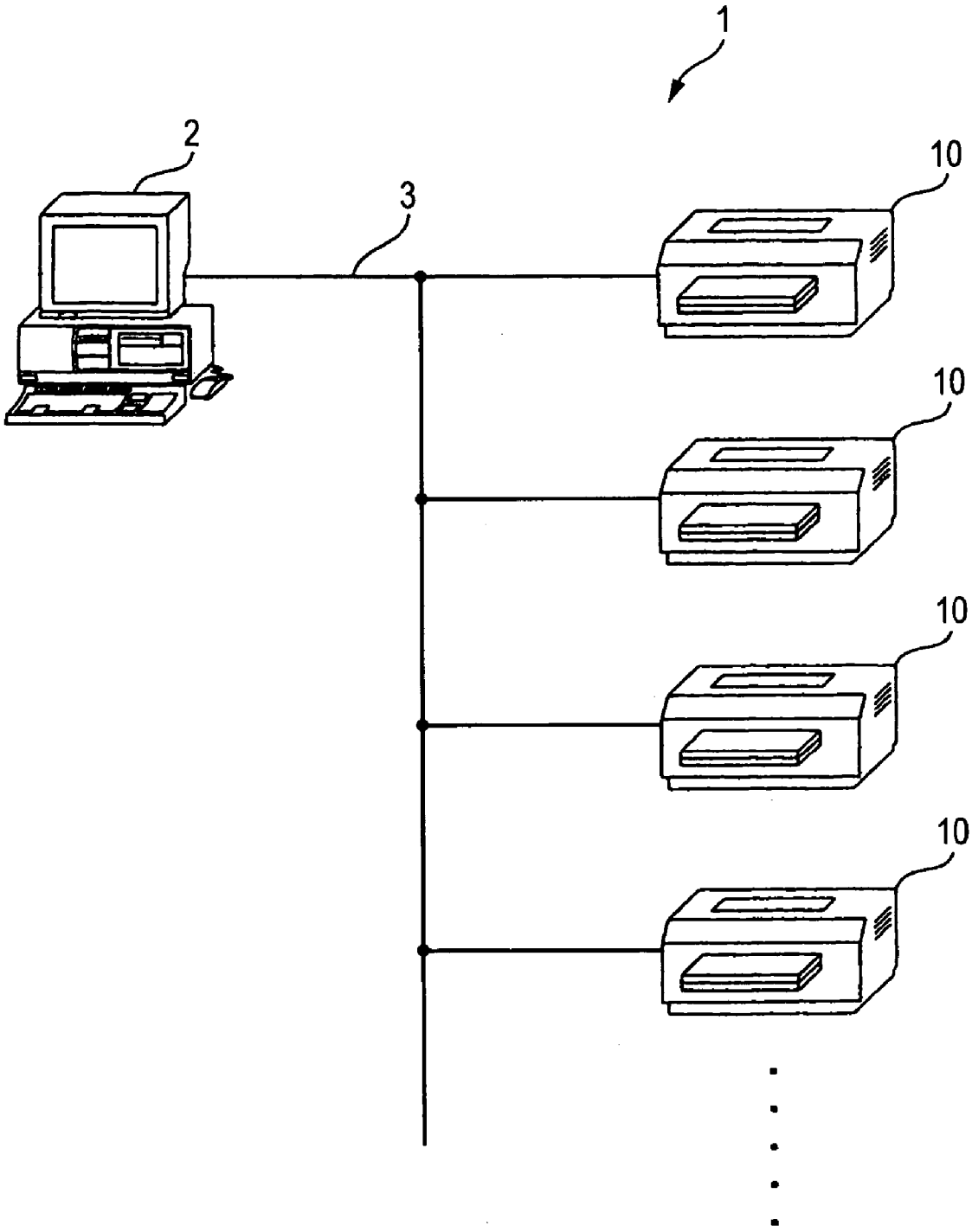
FIG. 1 is a schematic diagram of an image forming system of an embodiment of this invention.

FIG. 1 shows an image forming system 1 of an embodiment of this invention. Image forming system 1 is arranged by a PC (Personal Computer) or other host device 2 being connected, for example, to a plurality of image forming devices 10 via a network 3. Host device 2 may, for example, be a control device, such as an MCU (Micro Controller Unit), etc., an input/output device, such as a touch panel, or a terminal besides a PC, which has a communication device for sending and receiving signals via network 3. Network 3 may be wired or wireless. Also, a plurality of host devices 2 may be connected to network 3.

Image forming system 1 is thus arranged so that host device 2 can control image forming devices 10 via network 3.

Figure 2:
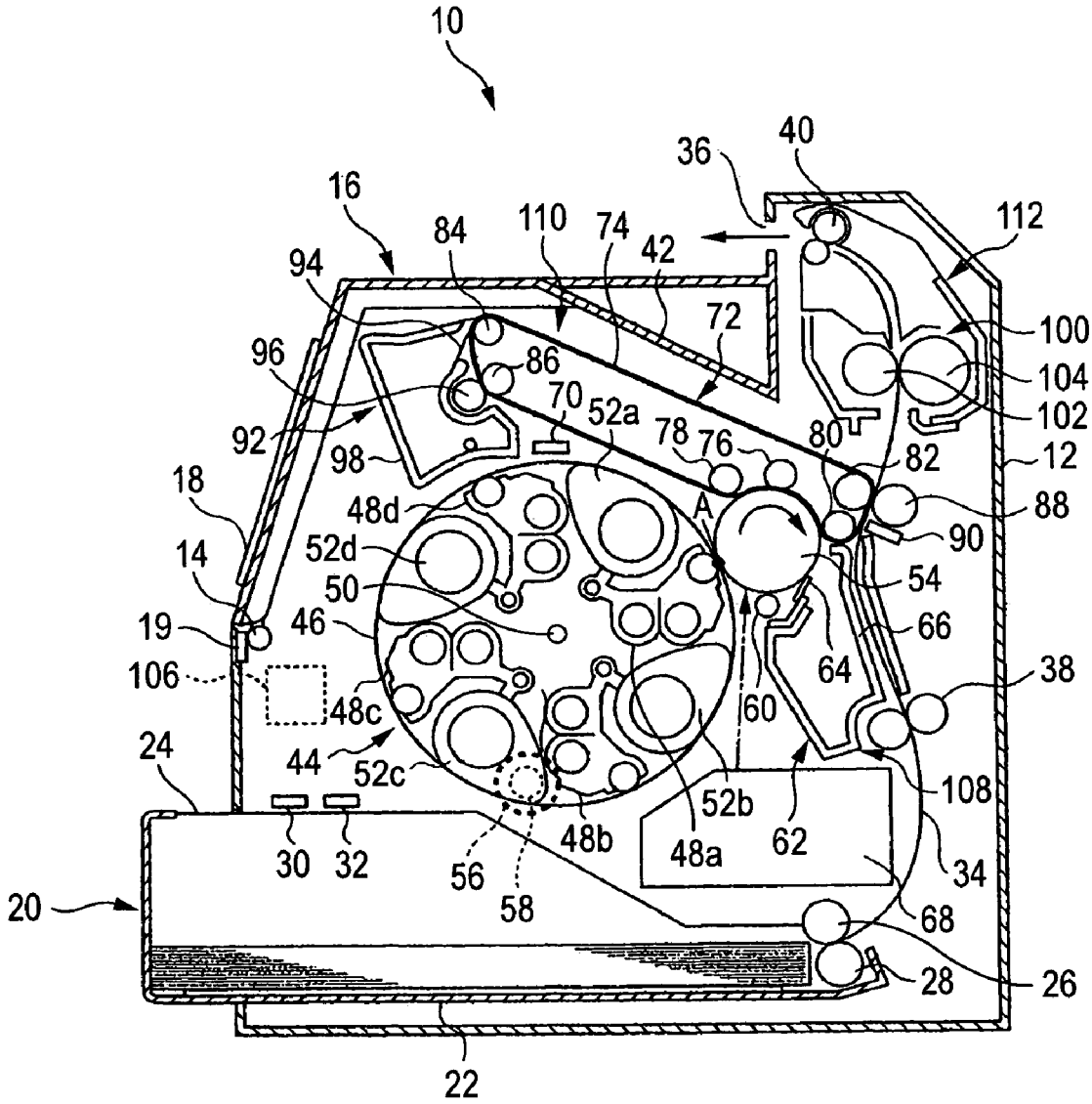
FIG. 2 is a side view showing an outline of an image forming device of this invention's embodiment.

FIG. 2 shows an image forming device 10 in outline. Image forming device 10 has an image forming device main body 12, and an opening/closing cover 16, which is rotatable about a rotation pivot 14, is provided on an upper part of this image forming device main body 12. A user interface (UI device) 18, which, for example, is a touch panel, etc., is provided on the front face side (left side in FIG. 2) of opening/closing cover 16. UI device 18 displays control information, instruction information, etc., of image forming device 10 and accepts instruction information and other inputs provided by a user. That is, the user can operate image forming device 10 via UI device 18. UI device 18 may be a device that just accepts the inputs of switches, etc., or may be a device that just outputs indications, etc., or may be a device that combines these functions.

Also in the vicinity of rotation pivot 14 is provided an opening/closing detection sensor 19, which detects the opening/closing of opening/closing cover 16, for example, by contacting/separating in accordance with the opening/closing of opening/closing cover 16.

A paper feed unit 20, for example, of a single stage, is positioned at a lower part of image forming device main body 12. Paper feed unit 20 has a paper feed unit main body 22 and a paper feed cassette 24 in which paper sheets are housed. At an upper part near the inner end of paper feed cassette 24 are positioned a feed roll 26, which supplies paper from paper feed cassette 24, and a retard roll 28, which separates the supplied paper one sheet at a time. Also, above paper feed cassette 24 are provided a temperature sensor 30, which detects the temperature inside image forming device main body 12, and a humidity sensor 32, which detects the humidity inside image forming device main body 12.

A conveying path 34 is a passage for paper from feed roll 26 to an ejection opening 36, and this conveying path 34 is formed substantially vertically from paper feed unit 20 to a fixing device 100, which shall be described later and is positioned near the rear side (right side face in FIG. 2) of image forming device main body 12. A secondary transfer roll 88 and a secondary transfer backup roll 82, to be described later, are positioned at the upstream side of fixing device 100 of conveying path 34, and resist roll 38 is positioned at the upstream side of secondary transfer roll 88 and secondary transfer backup roll 82. An ejection roll 40 is positioned near ejection opening 36 of conveying path 34.

Paper sheets, which are fed by feed roll 26 from paper feed cassette 24 of paper feed unit 20, are thus separated by retard roll 28 so that just the topmost paper sheet is guided to conveying path 34, stopped temporarily by resist roll 38, subject to the transfer of a toner image by being passed, at an adjusted timing, between secondary transfer roll 88 and secondary transfer backup roll 82 to be described later, subject to fixing of the transferred toner image by fixing device 100, and ejected by ejection roll 40 from ejection opening 36 onto an ejection part 42, provided at an upper part of opening/closing cover 16. This ejection part 42 is inclined so as to be low at the ejection opening portion and to become gradually higher in the direction of the front face (left direction in FIG. 2).

A rotary developing device or other developing device unit 44 is positioned, for example, at a substantially central part of image forming device main body 12. Developing device unit 44 has a developing device unit main body 46, and four developing devices 48*a* to 48*d*, which form toner images, are mounted to this developing device unit main body 46. These developing devices 48*a* to 48*d* rotate, along with developing device unit main body 46, left-handedly (counterclockwise in FIG. 2) about a rotation shaft 50. Cylindrical toner cartridges 52*a* to 52*d*, containing yellow (Y), magenta (M), cyan (C), and black (K) toners, are mounted to developing devices 48*a* to 48*d*, respectively. When toner cartridges 52*a* to 52*d* are mounted via developing devices 48*a* to 48*d* onto developing device unit main body 46, the outer surfaces thereof are made substantially flush with the outer circumference of developing device unit main body 46.

An image carrying body 54, including, for example, a photoconductor, is positioned so as to contact developing device unit 44 from the back face side (right side in FIG. 2) of image forming device 10. That is, with developing device unit 44, the four colors of Y, M, C, and K for full-color developing are prepared, and developing devices 48*a* to 48*d* are respectively moved rotatingly and positioned at a position opposing image carrying body 54 to successively develop a latent image on image carrying body 54, one color at a time with the yellow (Y), magenta (M), cyan (C), and black (K) toners.

Also, near a position substantially opposite image carrying body 54 across rotation shaft 50 of developing device unit 44 is positioned a wireless communication unit 56. This wireless communication unit 56 has an antenna 58 and performs wireless communication with a memory chip 170 to be described later.

Below image carrying body 54 is provided a charging device 60, including, for example, a charging roll that uniformly charges this image carrying body 54. Also, an image carrying body cleaner 62 is put in contact with image carrying body 54 at the upstream side of charging device 60 in the rotation direction. Image carrying body cleaner 62 includes, for example, a cleaning blade 64, which scrapes off the toner that remains on image carrying body 54 after primary transfer, and a waste toner recovery bottle 66, which recovers the toner that is scraped off by cleaning blade 64.

The back face side (right side in FIG. 2) of waste toner recovery bottle 66 has, for example, ribs, etc., formed thereon and is thereby formed into a curved surface so as to form a part of conveying path 34 that enables paper to be conveyed smoothly.

Below the back face side of developing device unit 44 is positioned an exposure device 68, which writes a latent image by means of laser light or other light ray onto image carrying body 54, which has been charged by charging device 60. Also, above developing device unit 44 is positioned a non-use detection sensor 70, which, for example, is a reflection type photosensor, etc., and detects whether toner cartridges 52*a* to 52*d*, mounted to developing device unit 44, have not been used or have been used. Above developing device unit 44 and non-use detection sensor 70 is provided an intermediate transfer device 72, which subjects the abovementioned toner image, visualized by developing device unit 44, to primary transfer one color at a time at a primary transfer position on each turn of an intermediate transfer body 74, and after thereby overlapping the toner images of four colors onto intermediate transfer body 74, performs batch transfer onto a paper sheet at a secondary transfer position to be described later.

Intermediate transfer device 72 includes, for example, an intermediate transfer belt or other intermediate transfer body 74, a primary transfer roll 76, a wrap-in roll 78, a wrap-out roll 80, secondary transfer backup roll 82, a scraper backup roll 84, and a brush backup roll 86. Intermediate transfer body 74, for example, has elasticity and is spanned substantially flatly above developing device unit 44 so as to have long sides and short sides. The long side at the upper face side of intermediate transfer body 74 is, for example, spanned so as to be substantially parallel with respect to ejection part 42 provided at the upper part of image forming device main body 12. Also, intermediate transfer body 74 has a primary transfer part (image carrying body wrapping region), which contacts image carrying body 54 in a wrapping manner between wrap-in roll 78, positioned at the long side at the lower face side and at the upstream side of primary transfer roll 76, and wrap-out roll 80, positioned at the downstream side of primary transfer roll 76, and is thereby wound across just a predetermined range of image carrying body 54 and follows the rotation of image carrying body 54.

Furthermore, at the rear side (right side face in FIG. 2) of intermediate transfer body 74, a flat part (short side) is formed by wrap-out roll 80 and secondary transfer backup roll 82, and this flat part serves as a secondary transfer part that faces conveying path 34.

The toner images on image carrying body 54 are thus primary transferred overlappingly in the order, for example, of yellow, magenta, cyan, and black by primary transfer roll 76 onto intermediate transfer body 74, which then conveys the primary transferred toner image towards the secondary transfer part.

Scraper backup roll 84 aids the scraping off of the toner remaining on intermediate transfer body 74 by a scraper 94, to be described later, after secondary transfer, and brush backup roll 86 aids the scraping off of the toner remaining on intermediate transfer body 74 by a brush roll 96, to be described later, after secondary transfer.

Secondary transfer roll 88 opposes secondary transfer backup roll 82 of intermediate transfer device 72 across conveying path 34. The interval between secondary transfer roll 88 and secondary transfer backup roll 82 is thus the secondary transfer position in the secondary transfer part, and by being aided by secondary transfer backup roll 82, secondary transfer roll 88 performs secondary transfer of the toner image that has been primary transferred onto intermediate transfer body 74 onto a sheet of paper at the secondary transfer position. Here, secondary transfer roll 88 is arranged to be separated from intermediate transfer body 74 while intermediate transfer body 74 turns three times, that is, while the toner images of the three colors of yellow, magenta, and cyan are being conveyed, and come in contact with intermediate transfer body 74 when the black toner image is transferred. A predetermined potential difference is made to arise across secondary transfer roll 88 and secondary transfer backup roll 82 and, for example, in the case where secondary transfer roll 88 is set to a high voltage, secondary transfer backup roll 82 is connected to the ground (GND), etc.

At the upstream side of the secondary transfer position, an image density sensor 90, which, for example, is a reflection type photosensor, etc., is positioned so as to oppose intermediate transfer body 74 across conveying path 34. Image density sensor 90 reads a toner patch that is formed on intermediate transfer body 74 to detect the density of the image formed on intermediate transfer body 74.

At the end of the side opposite the image carrying body side of intermediate transfer body 74, an intermediate transfer body cleaner 92 is disposed in a contacting manner. Intermediate transfer body cleaner 92 includes, for example, scraper 94, which scrapes off the residual toner and cleans secondary transfer body 74 after secondary transfer, brush roll 96, which further scrapes off the toner remaining after cleaning by scraper 94, and a waste toner recovery bottle 98, which recovers the toner scraped off by scraper 94 and brush roll 96. Scraper 94 is, for example, formed of a thin stainless-steel plate and has applied thereto a voltage of polarity opposite that of the toner. Brush roll 96 includes, for example, a brush formed of acrylic, to which a conductive treatment has been applied. Scraper 94 and brush roll 96 are separated from intermediate transfer body 74 while intermediate transfer body 74 conveys the toner images, and are arranged to contact intermediate transfer body 74 integrally at a predetermined timing.

Fixing device 100 is positioned above the secondary transfer position. Fixing device 100 has a heating roll 102 and a pressing roll 104, fixes the toner image, which was secondary transferred onto a paper sheet by secondary transfer roll 88 and secondary transfer backup roll 82, onto the paper sheet, and conveys the paper sheet toward ejection roll 40.

Also, inside image forming device main body 12 is positioned a control unit 106, which controls the respective parts that make up image forming device 10.

Image carrying body unit 108 integrates image carrying body 54, charging device 60, and image carrying body cleaner 62. Furthermore, image forming unit 110 integrates image carrying body unit 108, intermediate transfer device 72, and intermediate transfer cleaner 92. Also, fixing unit 112 integrates fixing device 100 and ejection roll 40.

Figure 3:
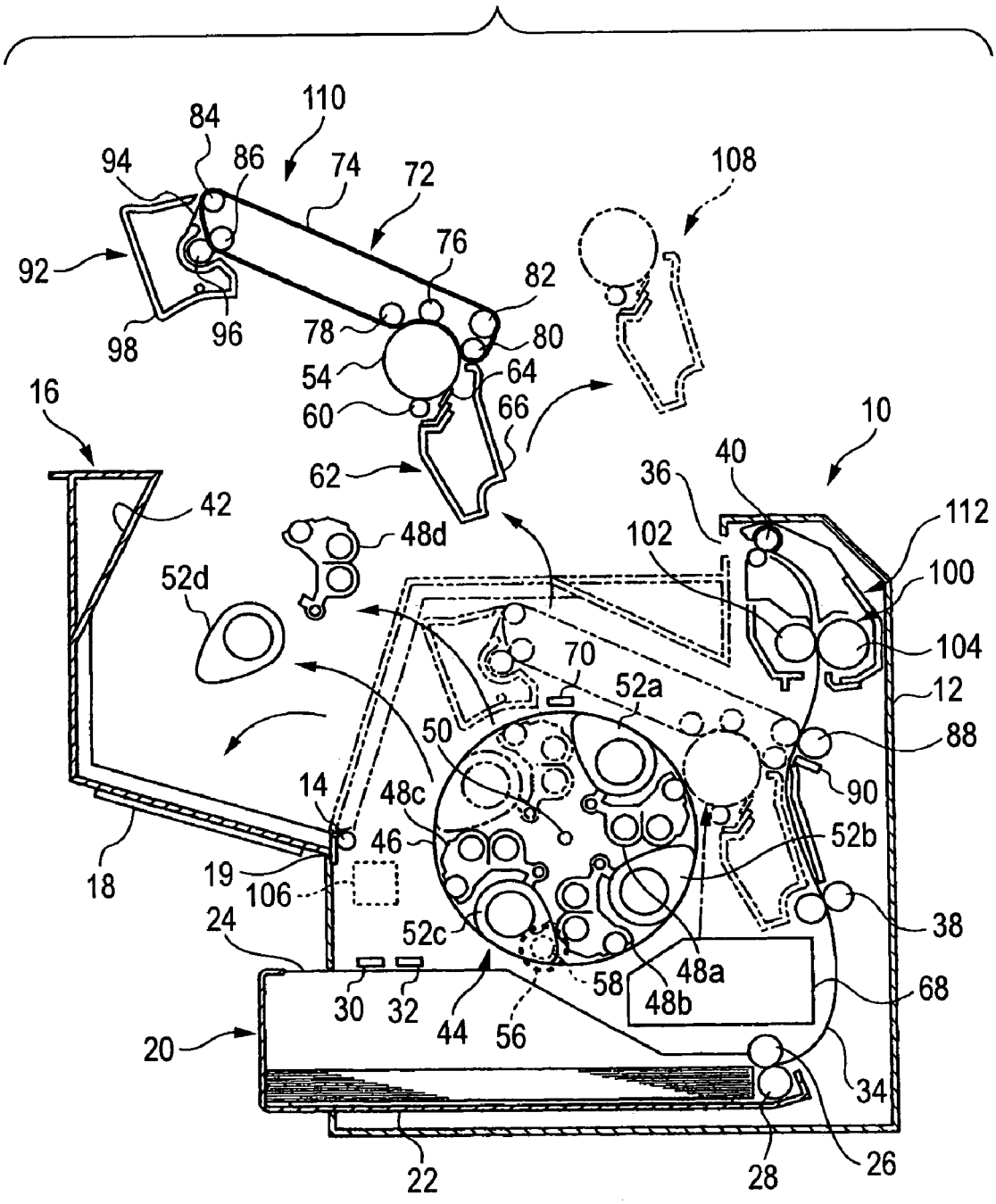
FIG. 3 is a side view showing, as an example, a state in which replaceable units of the image forming device of this invention's embodiment are detached from an image forming device main body.

As shown in FIG. 3, image forming unit 110 is made detachable with respect to image forming device main body 12 and can be attached or detached by opening opening/closing cover 16. Also, image carrying body unit 108 is made detachable with respect to image forming unit 110.

Toner cartridges 52*a* to 52*d* are made detachable with respect to developing devices 48*a* to 48*d*, mounted to developing device unit main body 46, when positioned at the front face side (opening/closing cover 16 side) with opening/closing cover 16 being opened. Developing devices 48*a* to 48*d* are made detachable with respect to developing device unit main body 46 when positioned at the front face side (opening/closing cover 16 side) with opening/closing cover 16 being opened.

Fixing unit 112 is made detachable with respect to image forming device main body 12 upon removal of an unillustrated upper cover. Other units, such as developing device unit 44 and paper feed unit 20 are also made detachable with respect to image forming device main body 12.

The respective units are thus enabled to be replaced by a user. Meanwhile, when in the case where a user mounts a replaceable unit onto image forming device 10, a product other than a genuine product for image forming device 10 is mounted, a problem, such as not being able to maintain satisfactory image quality, not being able to guarantee operation, etc., may occur. This is because image forming device 10 is controlled in accordance with the characteristics of the members used in image forming device 10. Sensors for detecting predetermined conditions, etc., are thus provided in a unit, etc., that is replaceable by a user.

In the following, in indicating a component, among components that are provided in plurality, such as developing devices 48*a* to 48*d*, etc., without specifying which of those components in particular, the component may be referred to simply in abbreviated form, such as "developing device 48."

An example of a replaceable unit, having sensors for determining predetermined conditions, etc., shall now be described.

Figure 4:
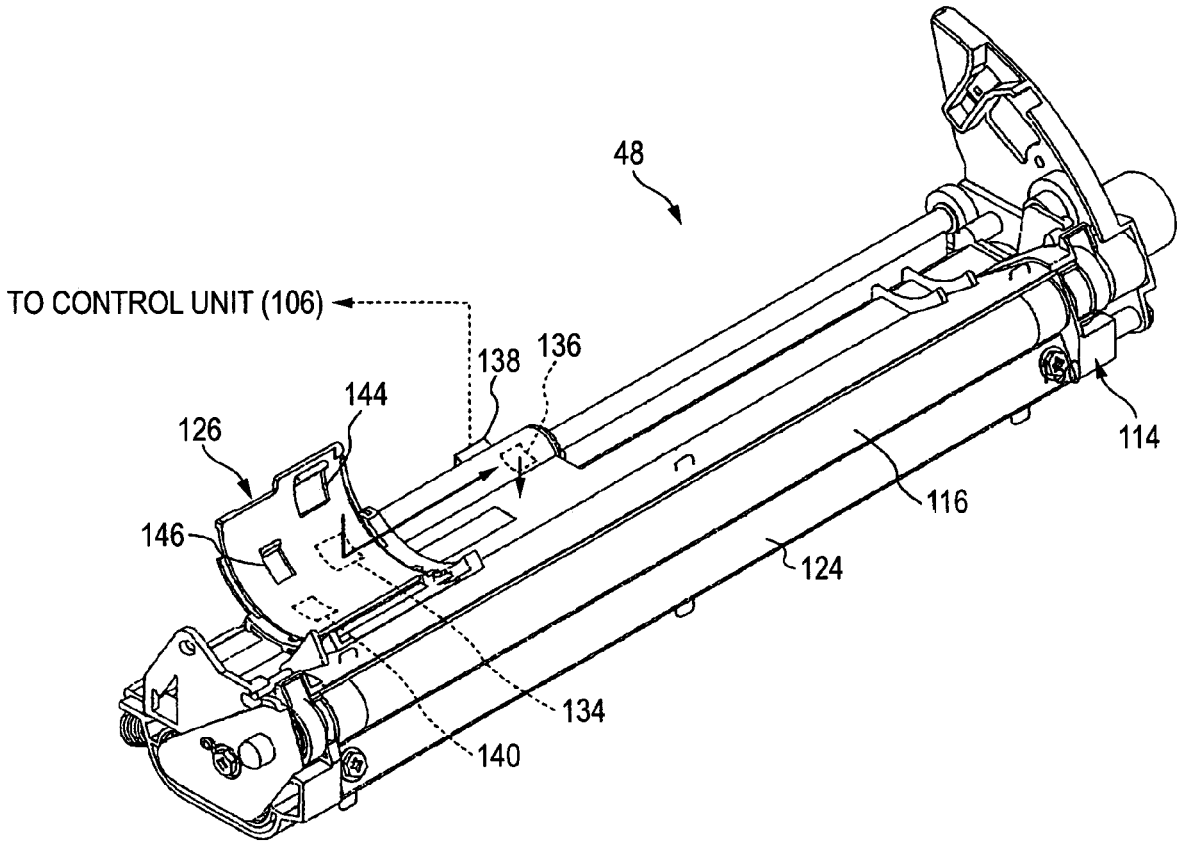
FIG. 4 is a perspective view showing a developing device of the image forming device of this invention's embodiment.
Figure 5:
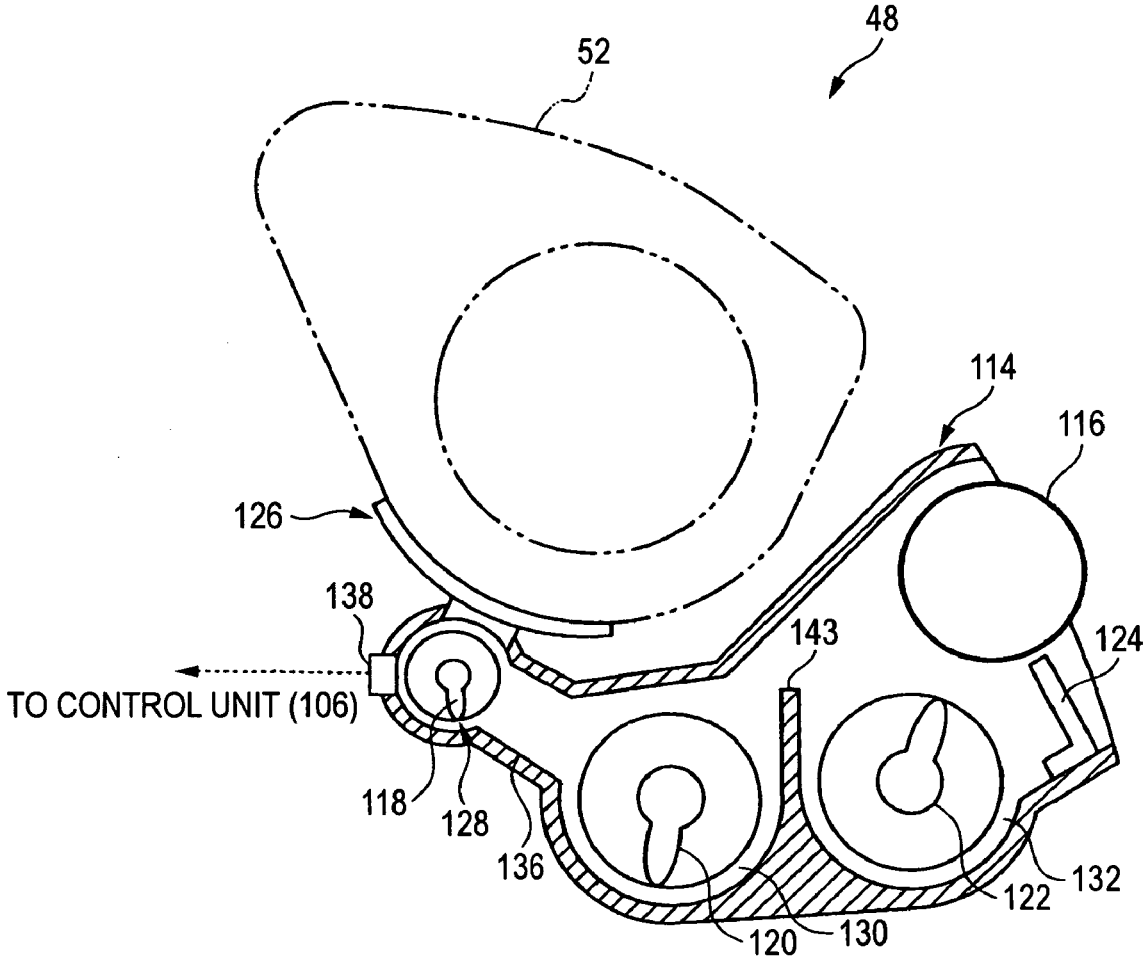
FIG. 5 is a schematic view showing a cross section of the developing device of the image forming device of this invention's embodiment.

FIG. 4 and FIG. 5 show the arrangement of a developing device 48, which is a replaceable unit.

Developing device 48 has a developing roll 116, which serves as a developer carrying body and is positioned at the image carrying body 54 side of a developing device housing (developing device main body) 114, a first auger 118, a second auger 120, a third auger 122, and a layer thickness restricting member 124 and contains, for example, a two-component developer including a nonmagnetic toner and magnetic toner.

Developing device housing 114 has a shutter 126, which opens and closes a toner receiving port 134 and a developer discharging port 140 to be described later, a cylindrical intake conveying path 128, for conveying of the toner taken in from a toner cartridge 52, and cylindrical developer conveying paths 130 and 132, for stirringly conveying the toner and the carrier.

Intake conveying path 128 has toner receiving port 134, which receives the toner from toner cartridge 52, and a toner feed port 136, which feeds toner into developer conveying path 130, and first auger 118 is disposed inside intake conveying path 128. First auger 118 conveys the toner received by intake conveying path 128 from toner cartridge 52 to developer conveying path 130. Also, by adjustment of the rotation of first auger 118, the amount of toner supplied from toner cartridge 52 to developing device 48 is adjusted. The toner concentration (ratio of the toner to carrier) and the toner charging amount of the developer are thereby controlled at predetermined values.

The toner usage amount (usage amount of toner cartridge 52) may also be arranged to be computed by a CPU 202 by accumulating the driving time or number of rotations of first auger 118. The toner usage amount may also be arranged to be computed by accumulating the current, which flows when exposure device 68 writes an electrostatic latent image on image carrying body 54, in the form of charges in a capacitor, etc., and by CPU 202 counting the number of times the accumulated charges have reached a predetermined amount.

The toner concentration is controlled at a predetermined value in order to prevent such problems as the following. For example, a toner concentration that is too high causes such problems as the toner charging amount becoming too low and a toner cloud arising to contaminate the interior of the image forming device, the toner becoming deposited on non-image parts of a paper and thereby causing fogging, the occurrence of retransfer, etc. A toner concentration that is too low causes such problems as the deposition of the carrier onto image parts of a paper due to charge injection, the lowering of the transfer efficiency due to the toner charging amount becoming too high, etc.

In intake conveying path 128, a toner detection sensor 138 is provided between toner receiving port 134 and toner feeding port 136, and this toner detection sensor 138 detects whether or not toner exists in intake conveying path 128 by detecting, for example, the variation of resistance, across two points inside intake conveying path 128, due to the existence or non-existence of toner. Toner detection sensor 138 may be a piezoelectric element instead.

Developer conveying path 130 has a developer discharge port 140, through which excess developer is discharged into toner cartridge 52, and second auger 120 is positioned inside developer conveying path 130. Second auger 120 stirringly mixes the toner and carrier, conveyed via intake conveying path 128, and conveys the mixture to developer conveying path 132.

Third auger 122 is positioned inside developer conveying path 132. Third auger 122 stirringly conveys the developer conveyed via developer conveying path 130 and supplies the developer to developing roll 116.

A partition plate 143 is disposed between developer conveying path 130 and developer conveying path 132, and at the respective ends of partition plate 143 are provided passages (not illustrated) that connect developer conveying path 130 with developer conveying path 132. Thus by second auger 120 and third auger 122 conveying the developer in alternate directions, the toner is made to become friction-charged to a charging amount of a predetermined polarity by the carrier and circulate inside developing device housing 114. Also, by degraded developer being discharged at a predetermined timing from developer discharge port 140 into toner cartridge 52, the total life of the developer is extended (trickle development system).

Shutter 126 has openings 144 and 146, and by opening 144 being overlapped with toner receiving port 134, a toner passage from toner cartridge 52 to developing device 48 is formed, and by opening 146 being overlapped with developer discharge port 140, a passage for excess developer from developing device 48 to toner cartridge 52 is formed.

Developing roll 116 carries the toner and contacts image carrying body 54 to develop the electrostatic latent image carried on image carrying body 54 by the toner. Layer thickness restricting member 124 restricts the layer thickness of the toner carried on developing roll 116.

Figure 6:
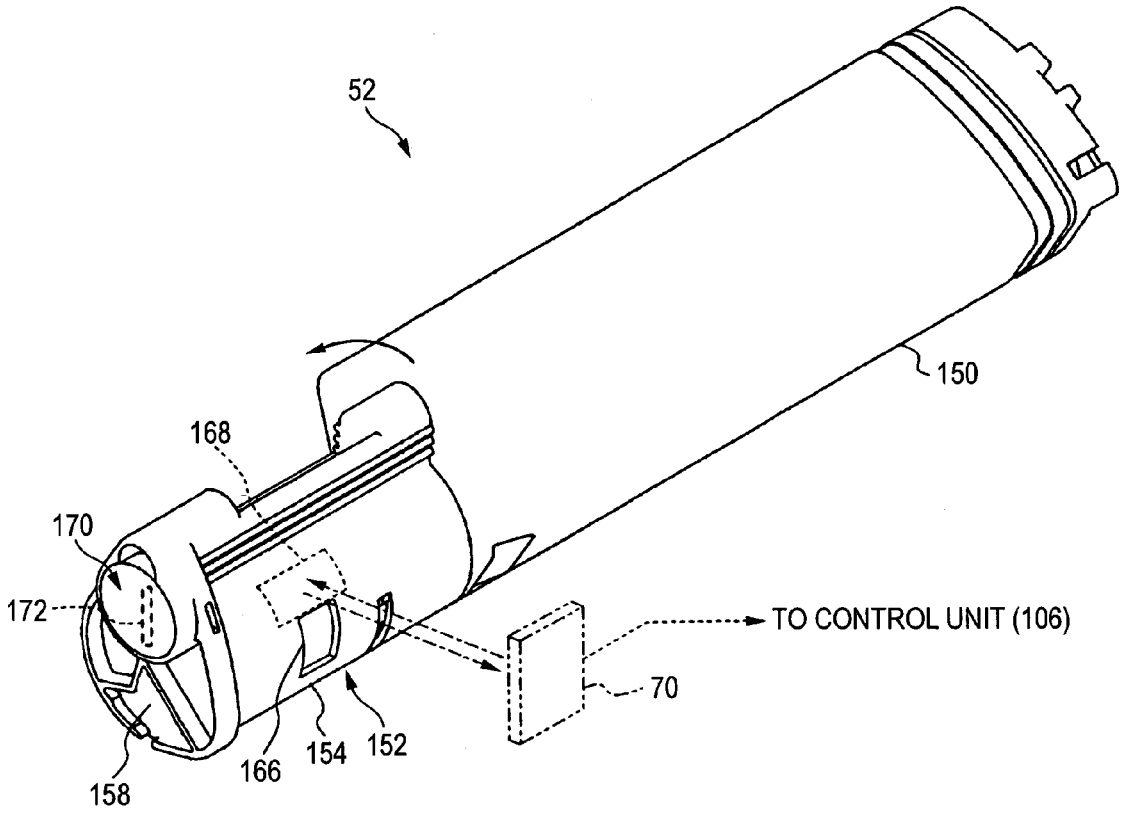
FIG. 6 is a perspective view showing a toner cartridge of the image forming device of this invention's embodiment.
Figure 7:
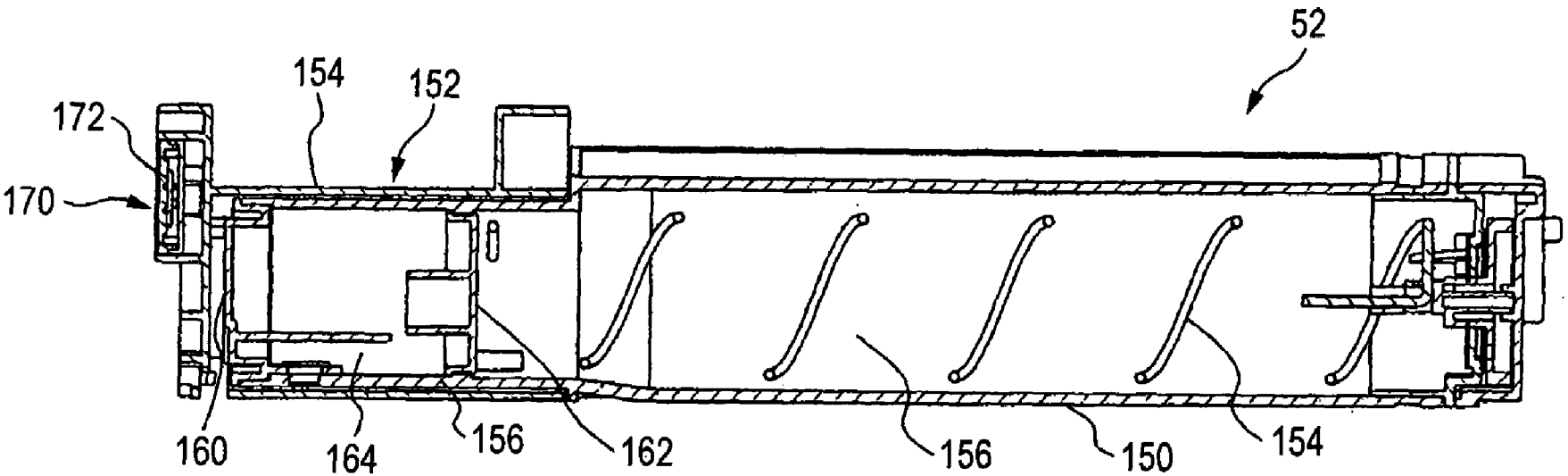
FIG. 7 is a sectional view showing the toner cartridge of the image forming device of this invention's embodiment.

FIG. 6 and FIG. 7 show the arrangement of a toner cartridge 52, which is a replaceable unit.

Toner cartridge 52 has a toner cartridge main body 150 and a rotating part 152, which is disposed at one end in the longitudinal direction of toner cartridge main body 150.

Toner cartridge main body 150 is formed to a tubular shape and is formed so that a substantially cylindrical portion, in the interior of which a stirring conveying member 154 is positioned, is made integral to a gradually narrowing portion that extends in a direction substantially perpendicular to the longitudinal direction from the substantially cylindrical portion. Toner cartridge main body 150 is also arranged so that its outer surface will be substantially flush with the outer periphery of developing device unit main body 46 when toner cartridge 52 is mounted via developing device 48 onto developing device unit main body 46.

A toner-containing space 156, which contains the toner that is to be supplied to developing device 48, is formed inside toner cartridge main body 150. The abovementioned stirring conveying member 154 is disposed in toner-containing space 156. This stirring conveying member 154 is, for example, wound in a spiraling manner and stirs the toner inside toner-containing space 156 while conveying the toner towards toner receiving port 134 of developing device 48.

Rotating part 152 has a rotating part main body 154 and a cylindrical tubular part 156, which is disposed inside rotating part main body 154 and is formed integral to toner cartridge main body 150. Tubular part 156 is sealed off at the side of a side face part 158 of rotating part main body 154 by a tubular part side wall 160 and has an isolating wall 162 provided in its interior. At the tubular part sidewall 160 side of isolating wall 162 is formed a developer recovery space 164 for recovering excess developer from developing device 48, and at the side opposite the tubular part side wall 160 side of isolation wall 162, the abovementioned toner-containing space 156 is formed in extending manner.

Rotating part main body 154, having a window-like window part 166 covered by a transparent member, is formed to be cylindrical at its inner side and is arranged to rotate along the outer face of the cylindrical portion of tubular part 156. Also, a reflecting member 168, which, for example, is a white tape, etc., is attached to the outer face of the cylindrical portion of tubular part 156, and when toner cartridge 52 is mounted to developing device 48 and rotating part main body 154, reflecting member 168 is arranged to be exposed via window part 166. Also, when developing device unit 44, to which toner cartridge 52 is mounted, rotates inside image forming device main body 12, the exposed reflecting member 168 is arranged to pass through a position opposing non-use detection sensor 70, which is fixed to image forming device main body 12. As mentioned above, non-use detection sensor 70 is, for example, a reflection type photosensor and, by detecting the reflection amount that varies due to the soiling of reflecting member 168 by the toner as reflecting member 168 of toner cartridge 52, mounted to developing device unit 44, passes through the position opposing non-use detection sensor 70, detects whether or not toner cartridge 52 is one that has not been used.

Memory chip 170 is attached to side face part 158 of rotating part main body 154. Memory chip 170 has an antenna 172 and performs wireless communication with wireless communication unit 56 disposed at the image forming device main body 12 side.

Next, in regard to wireless communication unit 56 and memory chip 170, the respective circuit arrangements and the communication carried out mutually between the two components shall be described.

Figure 8:
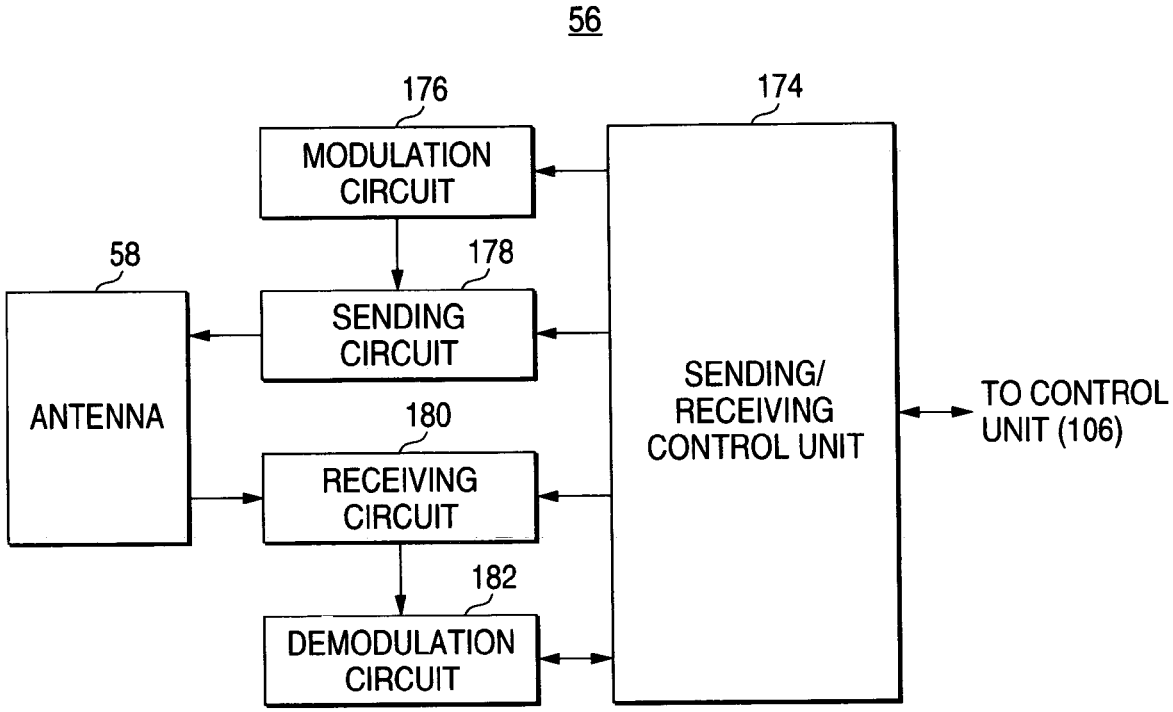
FIG. 8 is a block diagram showing the circuit arrangement of a wireless communication unit of the image forming device of this invention's embodiment.
Figure 9:
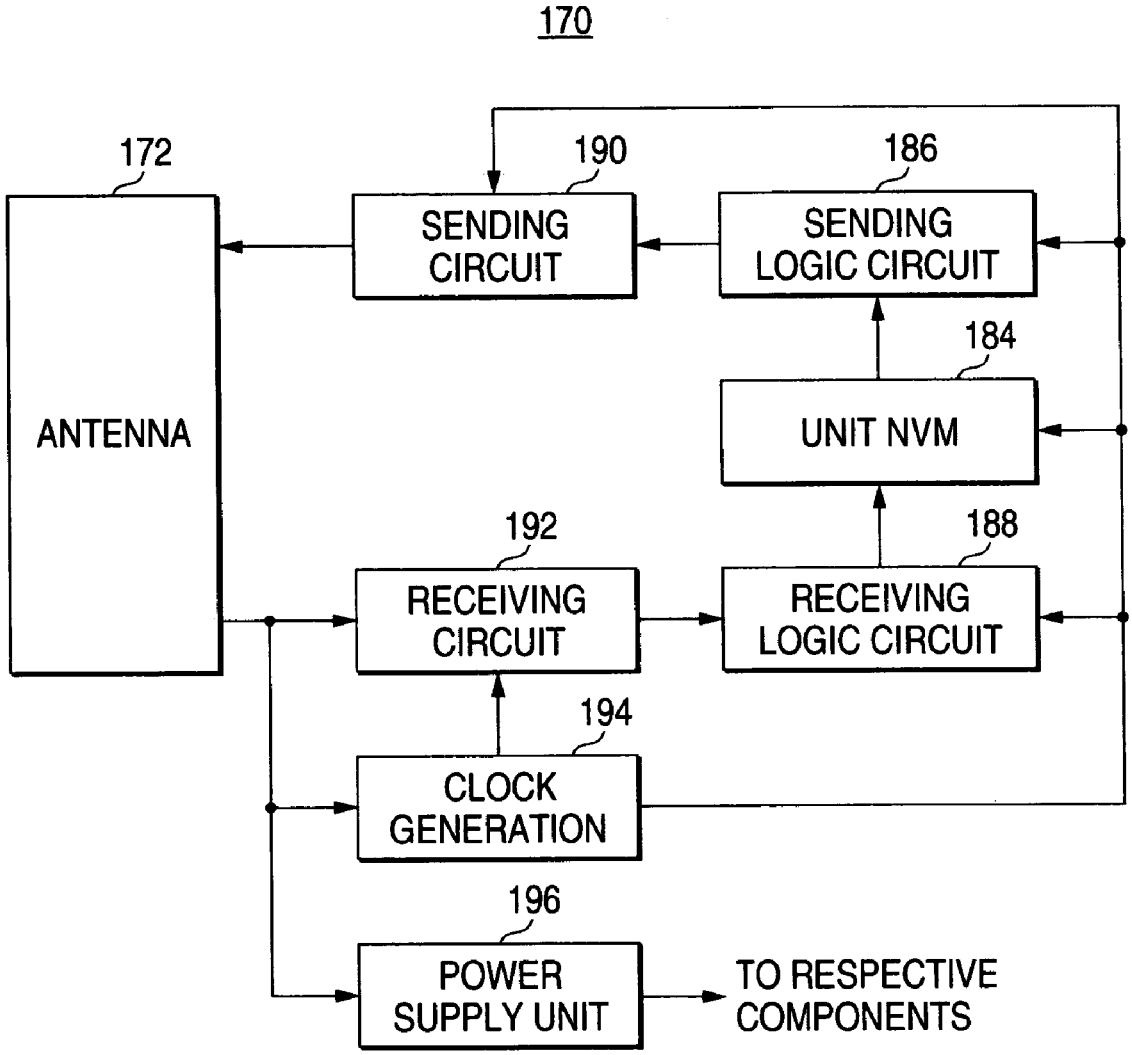
FIG. 9 is a block diagram showing the circuit arrangement of a memory chip of a toner cartridge used in the image forming device of this invention's embodiment.

FIG. 8 is a block diagram showing the circuit arrangement of wireless communication unit 56. FIG. 9 is a block diagram showing the circuit arrangement of memory chip 170.

As shown in FIG. 8, the circuit of wireless communication unit 56 includes a sending/receiving control unit 174, a modulation circuit 176, a sending circuit 178, a receiving circuit 180, a demodulation circuit 182, and antenna 58. In wireless communication unit 56, sending/receiving control unit 174 controls the operations of the respective components of wireless communication unit 56. Sending/receiving control unit 174 outputs data, input from control unit 106, to modulation circuit 176. Also, sending/receiving control unit 174 outputs data, received by receiving circuit 180 and demodulated by demodulation circuit 182, to control unit 106. Modulation circuit 176 modulates the data input from sending/receiving control unit 174 and outputs the data to sending circuit 178. Sending circuit 178 outputs radio signals, including data, clock signal, etc., to be stored in memory chip 170, to memory chip 170 via antenna 58.

Receiving circuit 180 receives signals sent from memory chip 170 via antenna 58 and outputs the signals to demodulation circuit 182. Demodulation circuit 182 demodulates the data sent from memory chip 170 based on variations of the signals input from receiving circuit 180 and outputs the data to sending/receiving control unit 174.

As shown in FIG. 9, the circuit of memory chip 170 includes a unit NVM (Non Volatile Memory) 184, a sending logic circuit 182, a receiving logic circuit 188, a sending circuit 190, a receiving circuit 192, a clock regeneration circuit 194, a power supply unit 196, and antenna 172.

When a radio signal is sent from wireless communication unit 56 to memory chip 170, this radio signal is received by receiving circuit 192, clock regeneration circuit 194, and power supply unit 196 via antenna 172. In memory chip 170, upon receiving the radio signal, power supply unit 196 rectifies the current resulting from electromagnetic induction due to the radio signal and supplies the respective components of memory chip 170 with the power necessary for their operations. If for example, a voltage higher than the voltage generated by power supply part 196 is required, memory chip 170 may be arranged to receive power from main body part 40. For example, a power supply coil, etc., may be provided further in memory chip 17 and the power may be supplied in a non-contacting manner from the AC current supplied to developing device unit 44.

Upon receiving the radio signal, clock regeneration circuit 194 regenerates a clock signal and outputs the clock signal to the respective circuits that make up memory chip 170. Upon receiving the radio signal, receiving circuit 192 outputs the data or other signal contained in the radio signal to receiving logic circuit 188 in synchronization with the clock signal input from clock regeneration circuit 194. In synchronization with the clock signal input from clock regeneration circuit 194, receiving logic circuit 188 demodulates the data or other signal input from receiving circuit and outputs the demodulated signal to unit NVM 184.

Unit NVM 184 is a writable non-volatile memory and, in synchronization with the clock signal input from clock regeneration circuit 194, performs the writing (storing) of data if the signal, input from receiving logic circuit 188, indicates the writing of data, while if the signal indicates the reading of data, outputs the data stored in unit NVM 184 to sending logic circuit 186. The non-volatile memory contained in unit NVM 184 may, for example, be a flash ROM, EEPROM, or FeRAM (ferroelectric memory).

In synchronization with the clock signal input from clock regeneration circuit 194, sending logic circuit 186 modulates the data input from unit NVM 184 and outputs the modulated data to sending circuit 190. In synchronization with the clock signal input from clock regeneration circuit 194, sending circuit 190 sends the signal input from sending logic circuit 186 as a radio signal to wireless communication unit 56 via antenna 172.

The signals that are sent and received as radio signals may be arranged to be sent and received upon being coded and thereafter converted into radio signals. For example, arrangements may be made so that a permitted user, etc., can rewrite the contents of unit NVM 184 from a device other than control unit 106 using coded radio signals.

Figure 10:
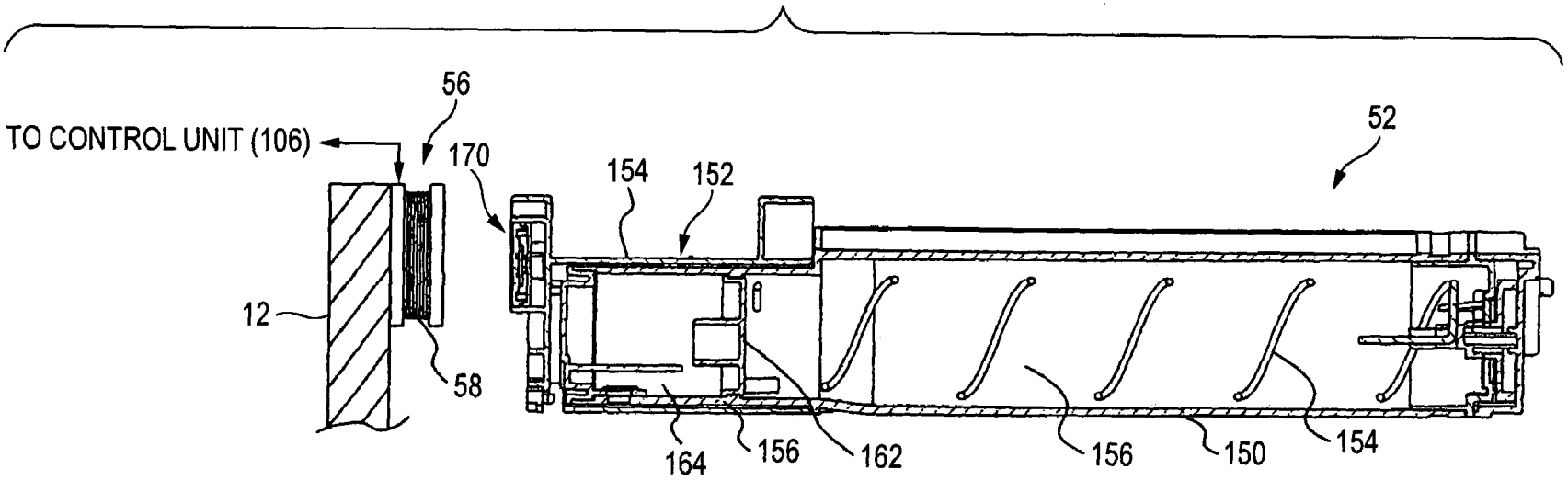
FIG. 10 is a sectional view showing the positional relationship of the wireless communication unit and a memory chip that perform wireless communication.

The positional relationship of wireless communication unit 56 and memory chip 170, which perform wireless communication, is shown in FIG. 10. As described above, each toner cartridge 52 is mounted to a developing device 48 and is moved by developing device unit 44 (FIG. 2) rotating about rotation shaft 50 as the axis. Wireless communication unit 56 is fixed to image forming device main body 12 in the vicinity of the side of developing device unit 44 so that each memory chip 170, which is moved by the rotation of developing device unit 44, will oppose it successively, and is arranged to perform wireless communication in a state in which the movement of a developing device 48 is controlled and stopped at a substantially opposing position so as to enable wireless communication with a corresponding memory chip 170. Also, wireless communication unit 56 is arranged, for example, to receive an acknowledge signal, sent by memory chip 170 in response to a radio signal output from wireless communication unit 56, to confirm the start of sending and receiving of data.

Figure 11:
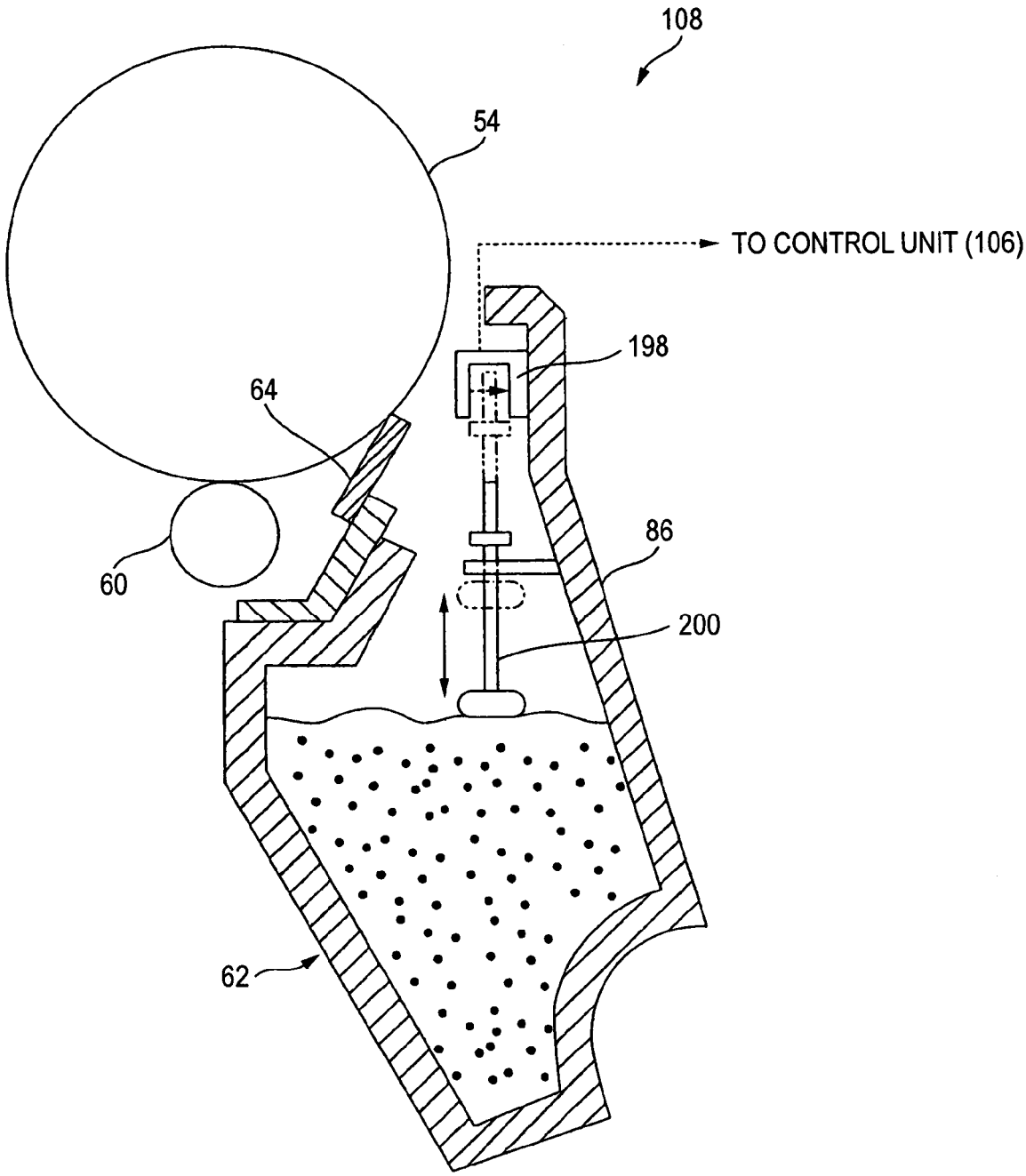
FIG. 11 is a side view showing the arrangement of an image carrying body unit used in the image forming device of this invention's embodiment.

FIG. 11 shows the arrangement of an image carrying body unit 108, which is a replaceable unit.

As mentioned above, image carrying body unit 108 integrates image carrying body 54, charging device 60, and image carrying body cleaner 62 and has a waste toner full sensor 198, disposed, for example, at an upper part of the interior of image carrying body cleaner 62, and a float 200, disposed below waste toner full sensor 198. Waste toner full sensor 198 has an optical path, wherein light emitted from a light emitting part disposed at one side is received by a light receiving part disposed at the other side, and outputs whether or not the light receiving part has received the light to control unit 106. Float 200 is arranged to rise when the waste toner, recovered in waste toner recovery bottle 66 from image carrying body 54, exceeds a predetermined amount and is arranged to block the optical path of waste toner full sensor 198 when waste toner recovery bottle 66 becomes full with waste toner. Image carrying body unit 108 thus detects whether or not waste toner recovery bottle 66 has become full by means of waste toner full sensor 198 and float 200 and outputs this information to control unit 106.

A waste toner full sensor 198 and a float 200 may also be provided at intermediate transfer body cleaner 92 to detect whether or not waste toner recovery bottle 98 has become full.

Each replaceable unit, having sensors, etc., for detecting predetermined conditions, is thus arranged to output the result of detection by the sensor, etc., to control unit 106, and control unit 106 is arranged to control the respective parts that make up image forming device 10 based on the input detection results.

The arrangement of control unit 106 shall now be described in detail.

Figure 12:
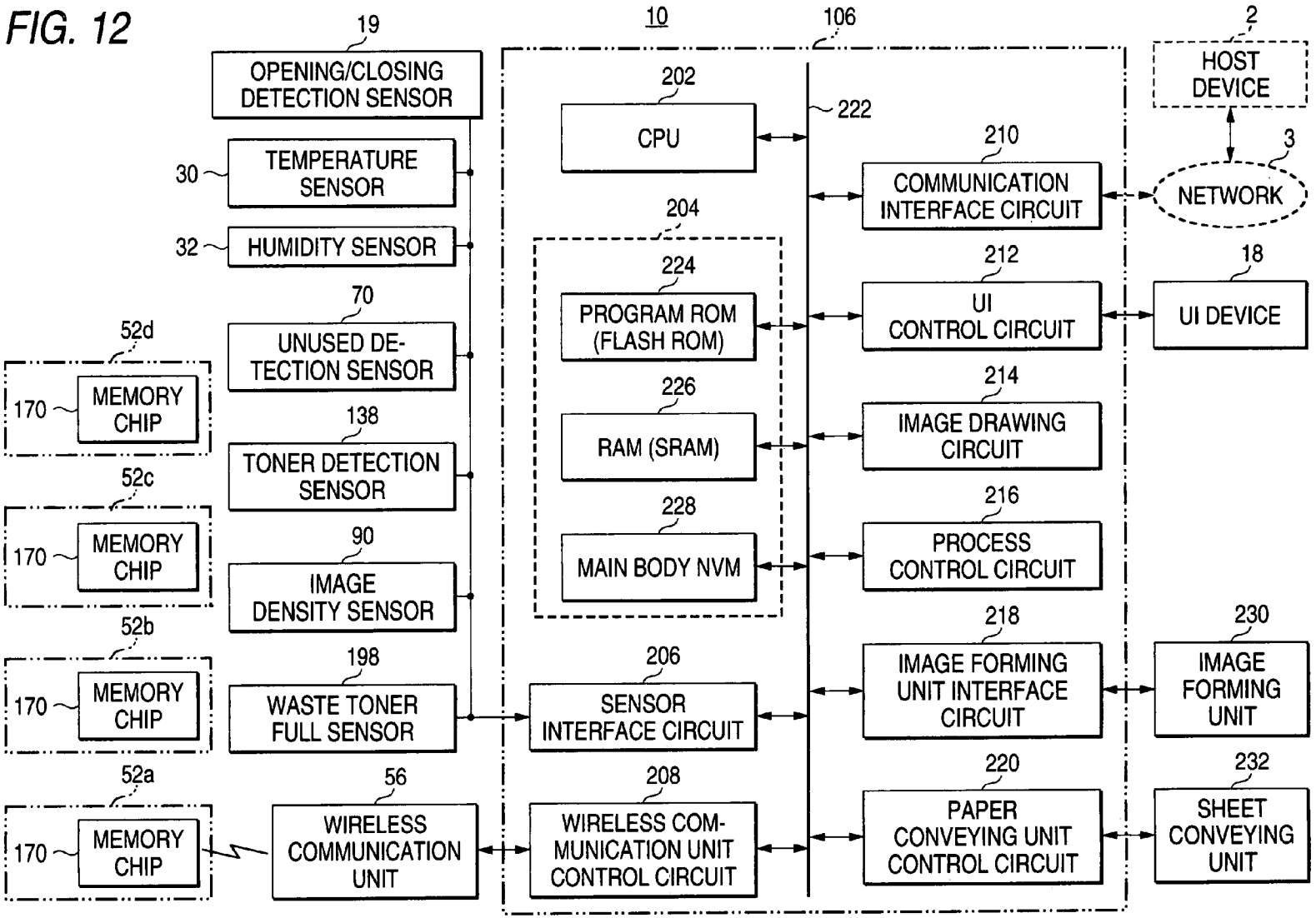
FIG. 12 is a block diagram showing the arrangement of a control unit of the image forming device of this invention's embodiment and various parts connected to the control unit.

FIG. 12 is a block diagram showing the arrangement of control unit 106 and respective parts connected to control unit 106.

Control unit 106 has CPU 202, a storage unit 204, a sensor interface (sensor I/F) circuit 206, a wireless communication unit control circuit 208, a communication interface (communication I/F) circuit 210, a user interface (UI) control circuit 212, an image drawing circuit 214, a process control circuit 216, an image forming unit interface (image forming I/F) circuit 218, a paper conveying unit control circuit 220, etc., and these are arranged to be able to input and output signals to each other via a system bus 222.

CPU 202 sends and receives signals to and from the respective parts that make up control unit 106 via system bus 222 and controls the respective parts that make up control unit 106.

Storage unit 204 has a program ROM 224, a RAM 226, and a main body NVM (Non Volatile Memory) 228 and stores information that are necessary for control of image forming device 10, etc. Program ROM 224 is arranged, for example, from a flash ROM and may be arranged to be renewed in the stored contents. RAM 226 is arranged, for example, from an SRAM and stores temporary information, such as the drawing data input from image drawing circuit 214. Main body NVM 228 is arranged from an electrically rewritable non-volatile memory, such as an EEPROM or a flash ROM. As long as main body NVM 228 is a rewritable storage device that can hold data even when the power of image forming device 10 is turned off, it may be an SRAM, with which the power supply is backed up by a battery, etc., an HDD (Hard Disk Drive), or an optical memory, etc.

Sensor I/F circuit 206 receives detection results from each of opening/closing detection sensor 19, temperature sensor 30, humidity sensor 32, non-use detection sensor 70, toner detection sensor 138, image density sensor 90, and waste toner full sensor 198 and outputs the detection results via system bus 222 to CPU 202. Wireless communication unit control circuit 208 sends and receives signals to and from the four memory chips 170, provided in toner cartridges 52*a* to 52*d*, respectively, via wireless communication unit 56, sends and receives signals to and from CPU 202, storage unit 204, etc., via system bus 222, and thereby connects the respective memory chips 170 to CPU 202, storage unit 204, etc.

Communication I/F circuit 210 sends and receives signals to and from host devices 2 via network 3, sends and receives signals to and from CPU 202, etc., via system bus 222, and thereby connects host device 2 to CPU 202, etc. UI control circuit 212 sends and receives signals to and from UI device 18, sends and receives signals to and from CPU 202, etc., via system bus 222, and thereby connects UI device 18 to CPU 202, etc.

Image drawing circuit 214 draws an image based on image forming signals input from a host device 2, etc., and outputs to CPU 202 and RAM 226. Process control circuit 216 references, along with CPU 202, setting values, etc., to be described later, that are stored in storage unit 204 and controls, via I/F circuit 218, an image forming unit 230, which includes exposure device 68, image forming unit 110, and developing device unit 44, etc. Paper conveying unit control circuit 220, along with CPU 22, controls a paper conveying unit 232, which includes feed roll 26, retard roll 28, resist roll 38, etc.

Since CPU 202 can compare the data stored in storage unit 204 and the data stored in unit NVM 184 to judge the state of a toner cartridge 52 to which a memory chip 170 is attached, memory chip 170 forms a part of the detection unit even though it does not have a sensor.

The details of the data stored in program ROM 224, main body NVM 228, and unit NVM 184 shall now be described.

Figure 13:
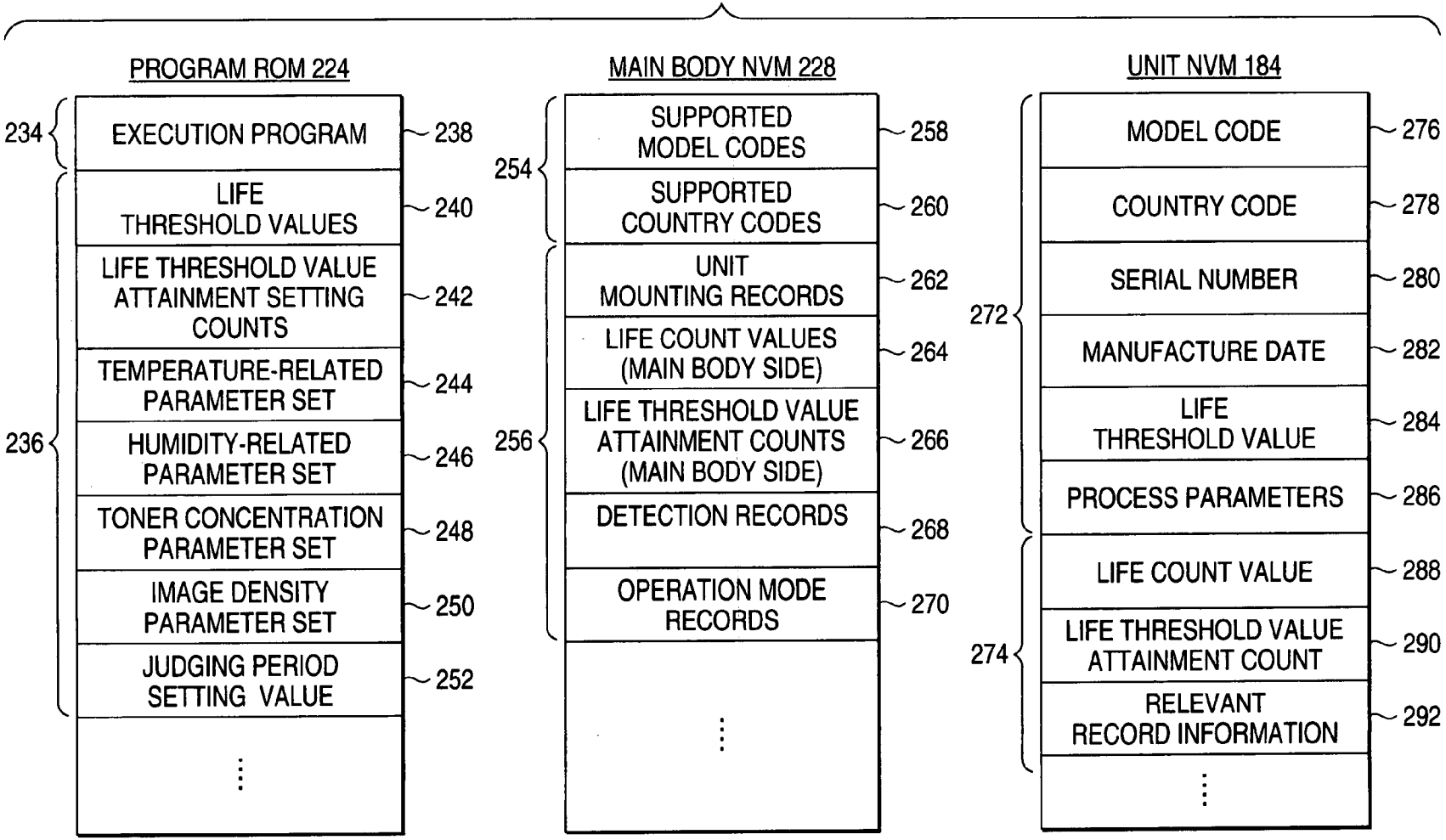
FIG. 13 is a memory map showing, as an example, data stored in a program ROM, a main body NVM, and a unit NVM.

FIG. 13 shows examples of the data stored in program ROM 224, main body NVM 228, and unit NVM 184.

A program area 234, a setting value area 236, etc., are set up in program ROM 224. An execution program 238, for making image forming device 10 operate, is stored in program region 234. Life threshold values 240, life threshold value attainment setting counts 242, temperature-related parameter set 244, humidity-related parameter set 246, toner concentration parameter set 248, image density parameter set 250, judging period setting value 252, etc., are stored in setting value area 236.

Life threshold values 240 include the lifetimes (life threshold values) of the respective replaceable units of image forming device 10. Life threshold value attainment setting counts 242 include the numbers of times the respective replaceable units of image forming device 10 are allowed to reach the respective life threshold values. Temperature-related parameter set 244 includes respective parameters concerning the control of image forming device 10 with respect to temperature. Humidity-related parameter set 246 includes respective parameters concerning the control of image forming device 10 with respect to humidity. Toner concentration parameter set 248 includes respective parameters concerning the control of the toner concentration in developing device 48. Image density parameter set 250 includes respective parameters concerning the control of the image density. Judging period setting value 252 includes the period (timing of judgment) until the point at which CPU 202 makes the judgment between a genuine item and a non-genuine item on each replaceable unit of image forming device 10 in a process, to be described later, in which image forming device 10 carries out printing preparations according to the operation mode.

A supported unit information area 254, a main body side renewal area 256, etc., are set up in main body NVM 228.

Supported model codes 258 and supported country codes 260 are stored in supported unit information area 254. As supported model codes 258, a table (data) of models, indicating, for each replaceable unit of image forming device 10, that the model of the unit is compatible with image forming device 10, is stored. As supported country codes 260, a table (data) of respective countries, in which specifications that differ according to country are set for each of the respective replaceable units of image forming device 10, is stored.

Unit mounting records 262, main body side life count values 264, main body side life threshold value attainment counts 266, detection records 268, and operation mode records 270, etc., are stored in main body side renewal area 256. Unit mounting records 262 include the mounting records of the respective replaceable units of image forming device 10. As the initial states (initial values) of unit mounting records 262, values, indicating that genuine products are mounted, are stored. Main body side life count values 264 include the life count values (usage amounts from the start of use to present) of the respective replaceable units of image forming device 10. The usage amounts of the respective units may be computed from the respective cumulative operation times of the units. Main body side life threshold value attainment counts 266 include the life threshold value attainment counts of the respective replaceable units of image forming device 10. Detection records 268 include the records of the detection results of the respective sensors provided in image forming device 10. Operation mode records 270 include the records the operation modes that are applied to the respective replaceable units of image forming device 10.

A unit information area 272, a unit side renewal area 274, etc., are set up in unit NVM 184.

A model code 276, indicating the model, a country code 278, indicating the country for which the specifications have been set, a serial number 280, unique to the unit, a manufacture date 282, a life threshold value 284, indicating the life of the unit, process parameters 286, for process control, etc., are stored in unit information area 272.

Life count value 288, indicating the usage amount of toner cartridge 52 from the start of use to present, life threshold value attainment count 290, indicating the number of times the life threshold value stored as life threshold value 284 has been reached, relevant record information 292, etc., are stored in unit side renewal area 27. Relevant record information 292 include, for example, the records of the rotation speed of image carrying body 54 and other relevant information that can be used to ascertain the circumstances of toner cartridge 52.

When an image forming signal is sent to the image forming device 10 of the above-described arrangement, image carrying body 54 is uniformly charged by charging device 60, and a light ray is emitted from exposure device 68 onto the charged image carrying body 54 in accordance with the image signal. The light ray from exposure device 68 exposes the surface of image carrying body 54 and a latent image is formed thereby.

The latent image that is carried on image carrying body 54 is developed at the developing position by developing device unit 44. In developing device unit 44, yellow, magenta, cyan, and black toners are supplied from toner cartridges 52*a* to 52*d*, respectively, to developing devices 48*a* to 48*d*, respectively. Developers that have been supplied in excess to developing devices 48*a* to 48*d* are recovered in toner cartridges 52*a* to 52*d*, respectively. Toner images, which have been developed according to color by developing devices 48*a* to 48*d* of developing device unit 44, are primary transferred in an overlapping manner onto intermediate transfer body 74. In the primary transfer process, the waste toner that remains on image carrying body 54 is scraped off by image carrying body cleaner 62 and recovered.

Meanwhile, paper, housed in paper feed cassette 24, is sent out by feed roll 26, separated and guided to conveying path 34 by retard roll 28, stopped once by resist roll 38, and guided between secondary transfer roll 88 and secondary transfer backup roll 82 at an adjusted timing. When a sheet of paper is guided between secondary transfer roll 88 and secondary transfer backup roll 82, the four-color toner image resulting from overlapping onto intermediate transfer body 74 by primary transfer is secondary transferred onto the sheet of paper by secondary transfer roll 88 and secondary transfer backup roll 82. After the secondary transfer, the waste toner remaining on intermediate transfer body 74 is scraped off by intermediate transfer body cleaner 92 and recovered.

The sheet of paper onto which the toner image has been transferred is guided to fixing device 100, and the toner image is fixed by heat and pressure by heating roll 102 and pressing roll 104. The paper sheet on which the toner image has been fixed is ejected from ejection opening 36 to ejection part 42 by ejection roll 40. Control unit 106 stores the life count values, etc., of toner cartridges 52 in unit NVM 184 and main body NVM 228.

The control of image forming device 10 based on the data stored in storage unit 204 (including main body NVM 228) shall now be described.

Figure 14:
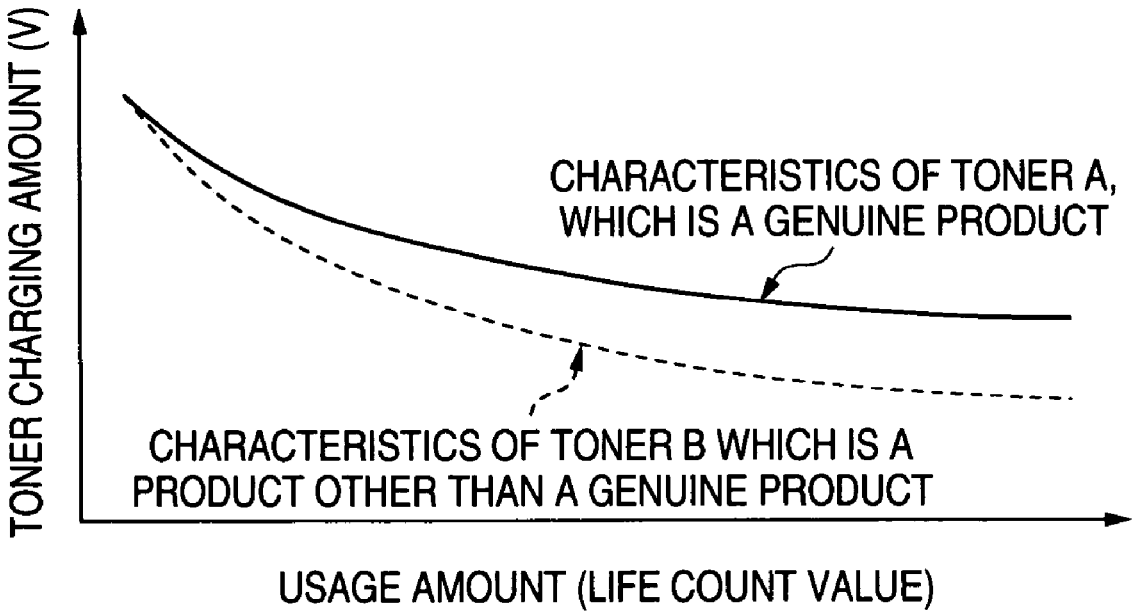
FIG. 14 is a graph showing the variation of the charging amount of toner with respect to the usage amount of the developing device when control is performed to make the toner concentration fixed.

FIG. 14 shows the variation of the toner charging amount with respect to the developing device usage amount when control at a fixed toner concentration is performed. Toner A, which is a genuine product that is contained in toner cartridge 52 that is a genuine product for image forming device 10, is friction-charged to a charging amount of predetermined polarity by the carrier inside developing device 48. However, since the developer degrades as toner cartridge 52 is mounted to developing device unit 44 and used, the toner decreases in charging amount in accordance with the usage amount of developing device 48. Also, the charging amount of the toner differs according to the type of toner. For example, with toner B, which is a product other than a genuine product, the charging amount will be lower than that of toner A, which is a genuine product, even if the usage amount of toner cartridge 52 is the same as that for toner A.

Figure 15:
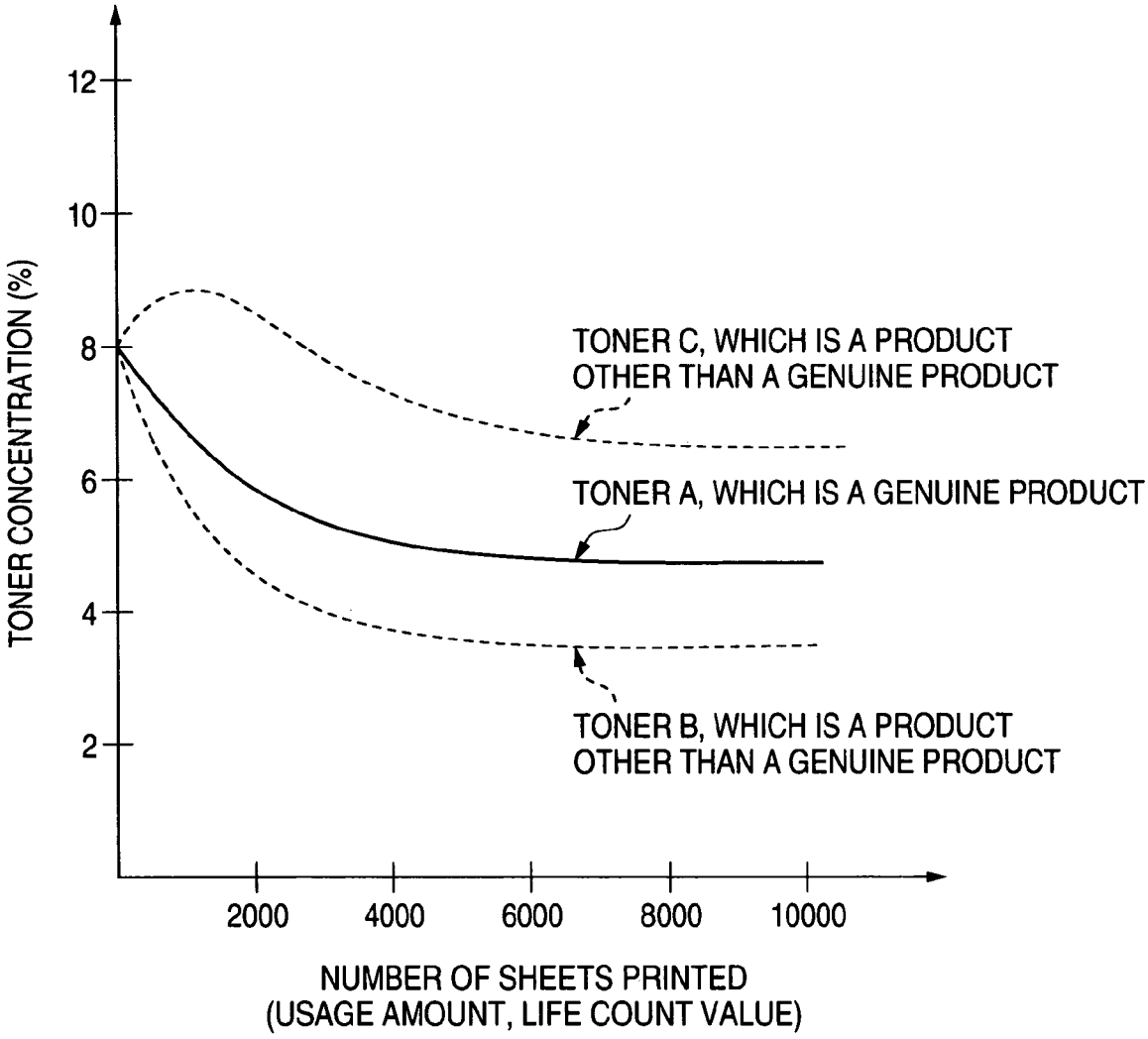
FIG. 15 is a graph showing the toner concentration with respect to the number of sheets printed by the image forming device when control is performed to make the image density of an image (patch) on an intermediate transfer body fixed.

FIG. 15 shows the toner concentration with respect to the number of sheets printed by image forming device 10 (usage amount or life count value of developing device 48 stored in main body NVM 228) when the image density of an image (patch) on intermediate transfer body 74 is controlled to be constant. Since as toner cartridge 52 is mounted to developing device unit 44 and toner A, which is a genuine product, is used in printing, the charging amount of the toner decreases and the developing amount increases due to degradation with use, when control is performed to make the image density of an image (patch) on intermediate transfer body 74 constant, the toner supply amount is restrained and the toner concentration drops gradually. Meanwhile, for example, when a toner B, which is a product other than a genuine product, is contained in toner cartridge 52 and used in printing, since toner B is greater in the lowering of toner charging amount than toner A, the toner concentration becomes lower than that in the case of toner A. Also, for example when a toner C, which is a product other than a genuine product, is contained in toner cartridge 52 and used in printing, the toner concentration rises once after the start of use and thereafter decreases in accordance with the number of sheets printed. The toner concentration thus varies differently with the number of sheets printed according to the type of toner.

Toner cartridges, other than those that are genuine products, include those with which just the toner contained in toner cartridge 52 is a non-genuine product.

Figure 16:
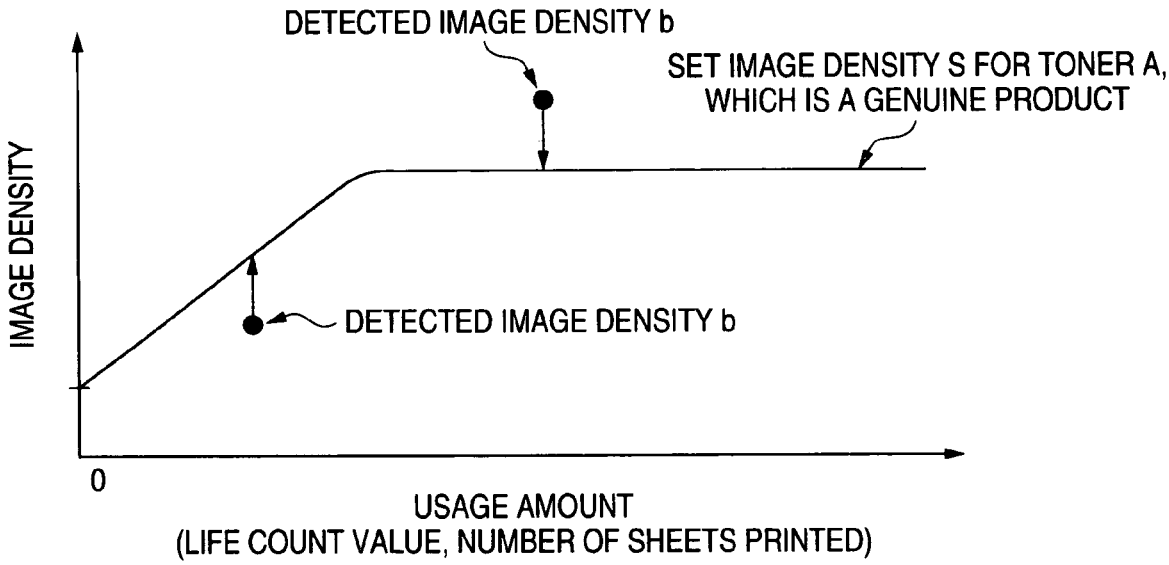
FIG. 16 is a graph showing a set image density S (target value) for an image on the intermediate transfer body that is in accordance with the usage amount of a developing device containing a toner A, which is a genuine product.

FIG. 16 shows a set image density S (target value) for an image on intermediate transfer body 74 that is in accordance with the usage amount of developing device 48 containing toner A, which is a genuine product. As mentioned above, the amount of toner supplied to developing device 48 from toner cartridge 52 is adjusted by CPU 202 adjusting the rotation of first auger 118. The image formed on intermediate transfer body 74 is adjusted to change in density in accordance with the image density (set image density) that is set, for example, by CPU 202 adjusting the rotation of first auger 118. As shown in FIG. 16, set image density S of a patch on intermediate transfer body 74 in the case of toner A, which is a genuine product, is set so that the image density increases in accordance with the usage amount of developing device 48. Set image density S is, for example, stored in the toner concentration parameter set 248 in program ROM 224.

In regard to set image density S, if the image density detected by image density sensor 90 is lower than set image density S as in the case of a detected image density a, CPU 202 extends the drive time of first auger 118 in the process of driving first auger 118 and thereby increases the amount of toner supplied to developing device 48. Also in regard to set image density S, if the image density detected by image density sensor 90 is higher than set image density S as in the case of a detected image density b, CPU 202 shortens the drive time of first auger 118 or stops first auger 118 to decrease the amount of toner supplied to developing device 48. Thus even when the charging amount of toner A drops in accordance with the usage amount of developing device 48, since the image density is set to increase in accordance with the usage amount of developing device 48 by means of set image density S, the toner concentration is corrected so as to be maintained at a predetermined level.

Figure 17:
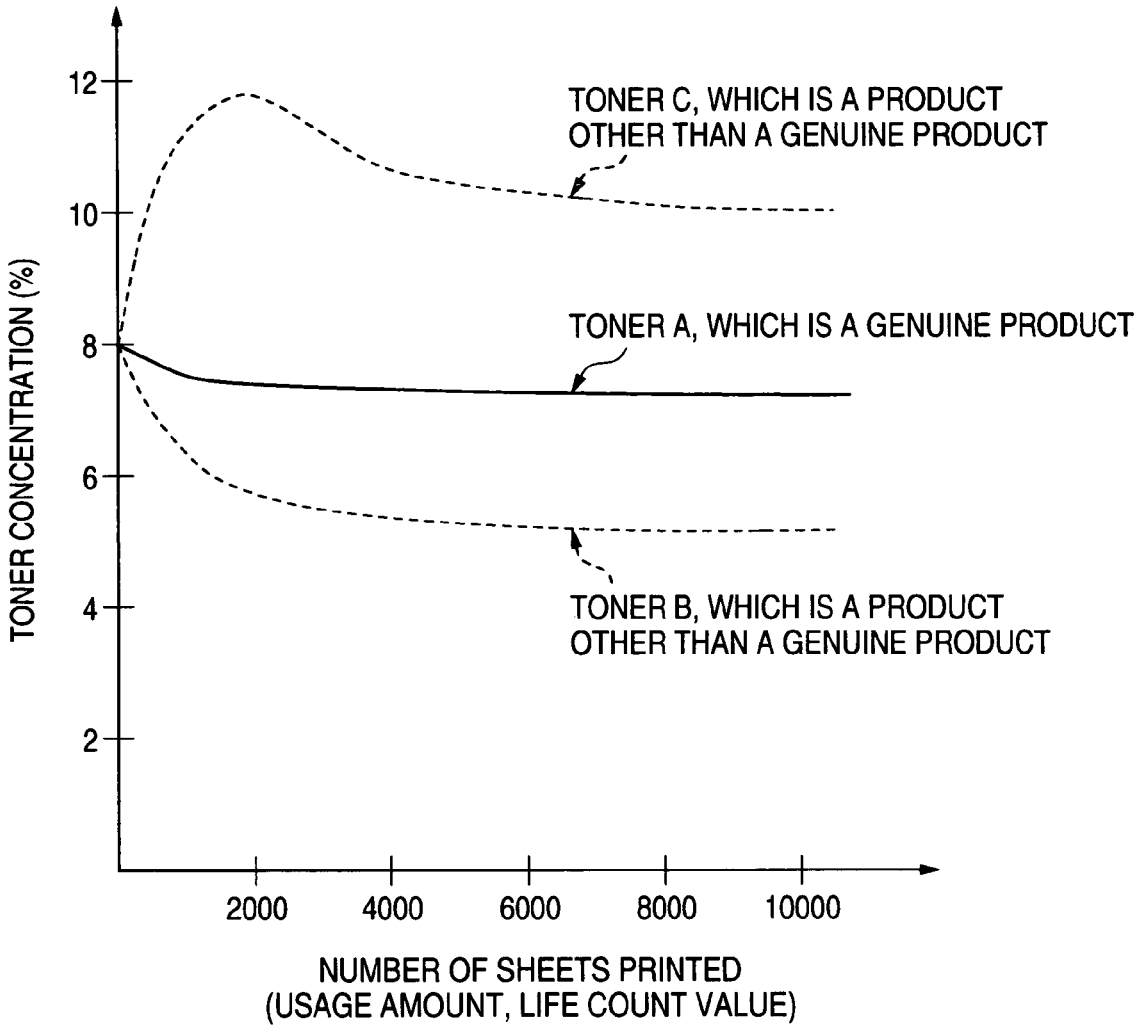
FIG. 17 is a graph showing the toner density, corrected by set image density S, with respect to the number of sheets printed by the image forming device.

FIG. 17 shows the toner concentration corrected for the number of sheets printed by image forming device 10 by means of set image density S. Even when the charging amount of toner A, which is a genuine product, drops in accordance with the usage amount of developing device 48, since the image density of a patch formed on intermediate transfer body 74 is corrected by set image density S, the dropping of the toner concentration from the initial value can be restrained and the toner concentration can be maintained at a predetermined level.

Meanwhile, with toner B, which is a product other than a genuine product, since the charging amount drops more in accordance with the usage amount than the charging amount of toner A, even when the image density of the patch formed on intermediate transfer body 74 is corrected by set image density S, the lowering of the toner concentration from the initial value cannot be restrained. Also with toner C, which is a product other than a genuine product, when the image density of a patch formed on intermediate transfer body 74 is corrected by set image density S, the toner concentration becomes higher than the initial value.

Since set image density S is set in accordance with the characteristics of toner A, which is a genuine product, even if set image density S is applied to a product other than a genuine product, the toner concentration cannot be corrected. Image forming device 10 is thus arranged so that a user can select, via UI device 18, a setting that differs from set image density S for a toner that is a product other than a genuine product.

Figure 18:
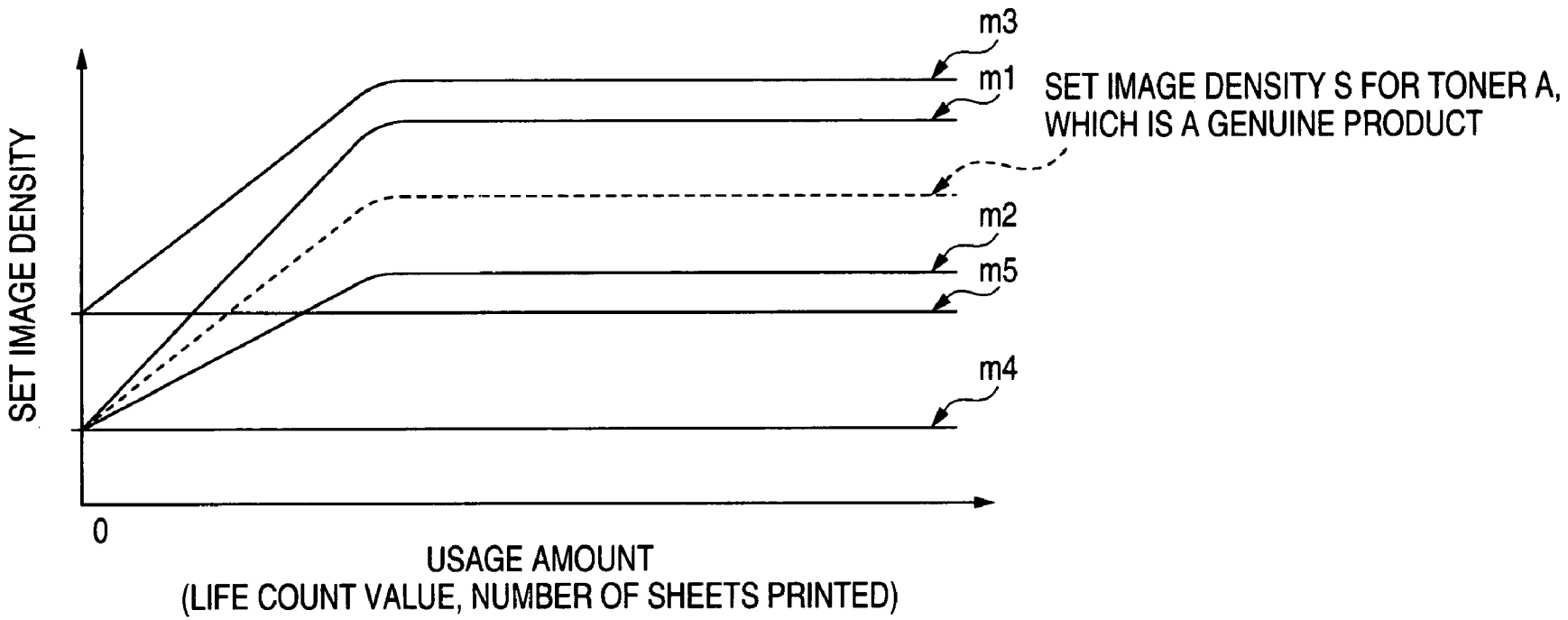
FIG. 18 is a graph showing the set image densities (target values) for an image on the intermediate transfer body in accordance with the usage amounts of developing devices containing toners that are products other than a genuine product.

FIG. 18 shows set image density values (target values) of an image on intermediate transfer body 74 in accordance with the usage amounts of developing devices 48 containing toners other than genuine products.

With image forming device 10, with respect to set image density S (default mode), the modes of: increasing or decreasing the variation amount (slope) of the set image density in accordance with the usage amount of developing device 48 containing a toner other than a genuine product (m1, m2); increasing or decreasing the limit value (m1, m2); changing the initial value (usage amount=0); not changing the setting in accordance with the usage amount (m4); and, for example, changing the initial value but not changing the setting in accordance with the usage amount (m5); etc., are provided as operation modes that differ from the operation mode accommodating genuine products. For example, when in the case where toner B, which is a toner other than a genuine product, is contained in toner cartridge 52 and used, m1 (operation mode 1) is selected for the set image density, the image density of a patch formed on intermediate transfer body 74 will approach the image density for the case where toner A, which is a genuine product, is contained in toner cartridge 52 and used.

Operation modes that differ from the operation mode accommodating genuine products may also be arranged by combining the image density setting with the settings of other parameters, etc.

Image forming device 10 also controls the display by UI device 18, etc., based on the data stored in storage unit 204 and unit NVM 184. For example, under control by CPU 202, UI device 18 displays the remaining amount of toner in the case where toner cartridge 52 is a genuine product. In the case where toner cartridge 52 is a product other than a genuine product, UI device 18 displays, along with the usage amount of the toner, etc., an indication that the operation of image forming device 10, the image quality, and the reliability cannot be guaranteed. Furthermore, by operation of UI device 18, the indication that the reliability, etc., cannot be guaranteed may be made not to be displayed.

A method of controlling image forming device 10 based on the data stored in storage unit 204 and unit NVM 184 shall now be described.

Figure 19:
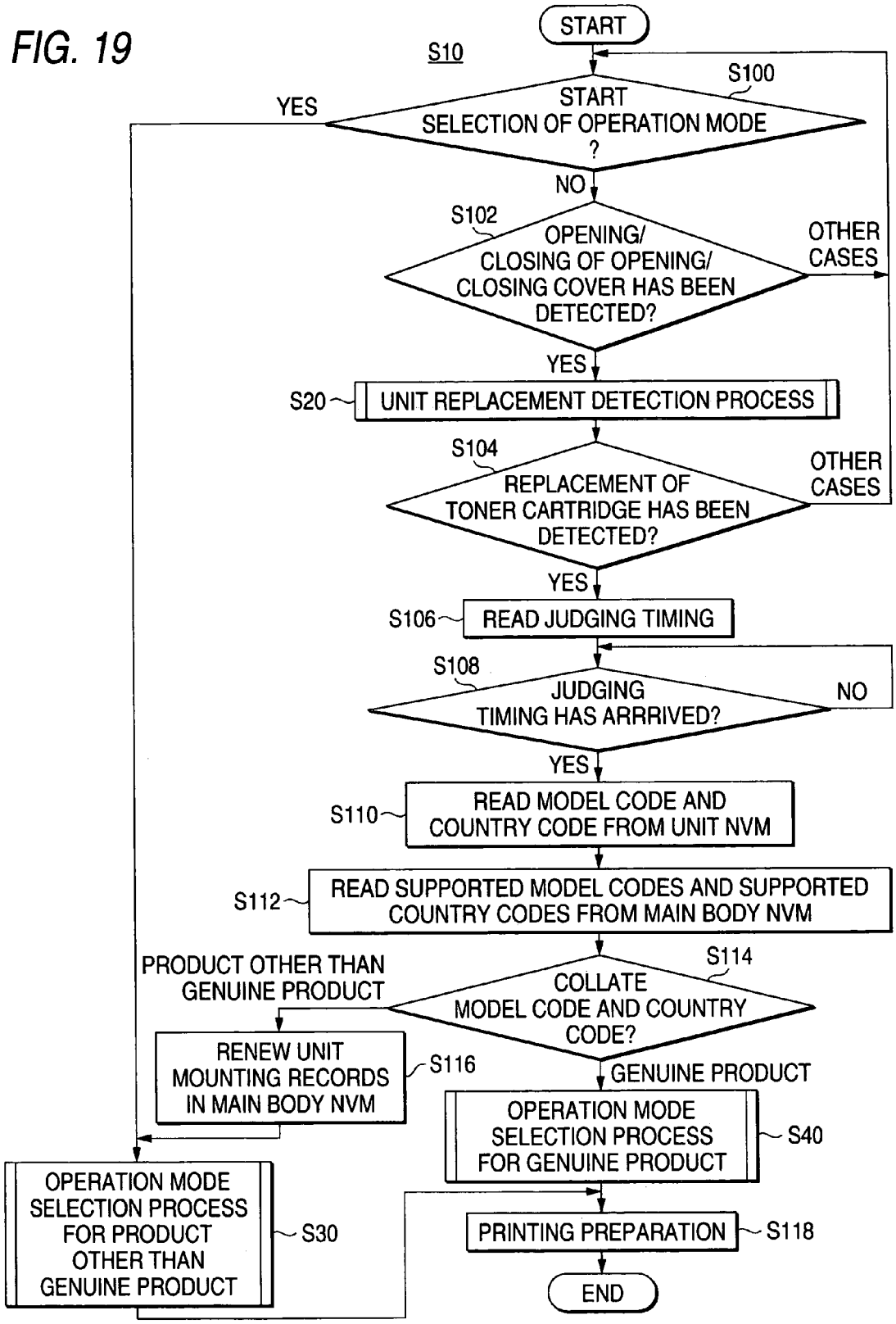
FIG. 19 is a flowchart (S10) illustrating the processes that the image forming device carries out in preparation for printing in accordance with an operation mode for the toner cartridge.

FIG. 19 is a flowchart (S10) illustrating the processes that image forming device 10 carries out in preparation for printing in accordance with an operation mode for toner cartridge 52.

Figure 20:
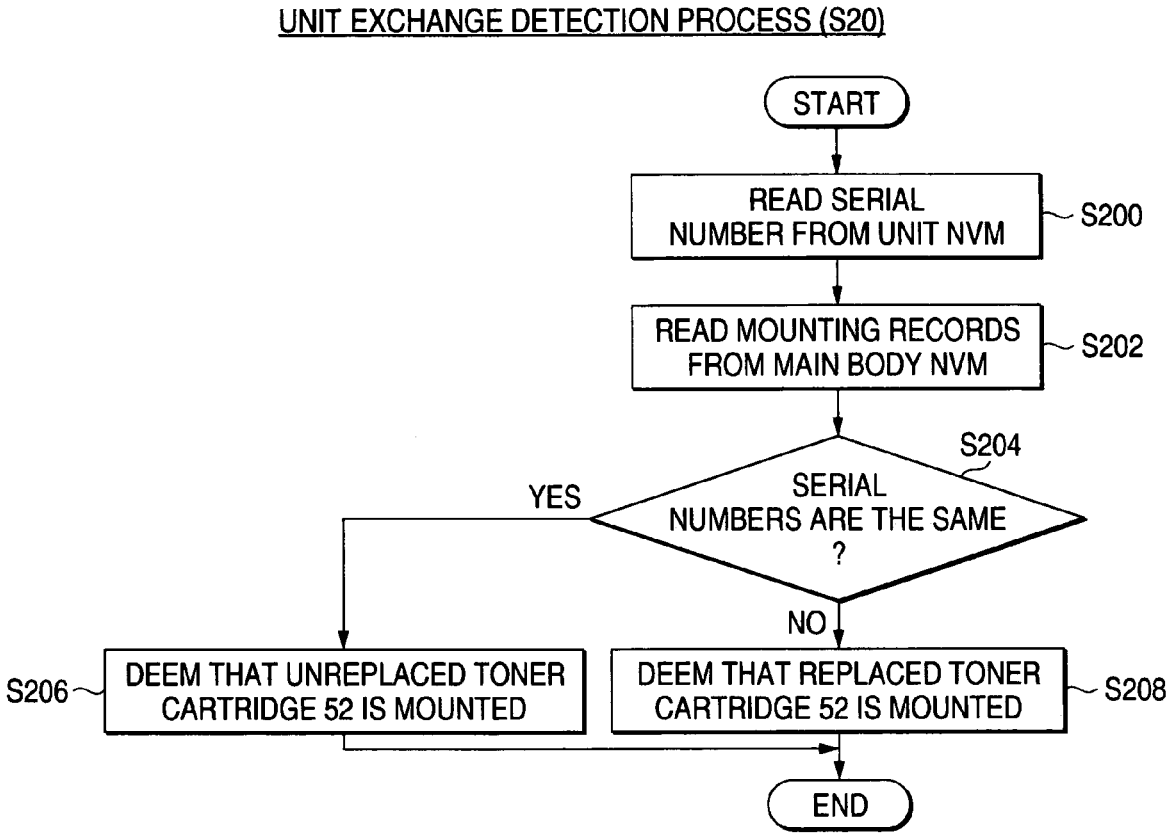
FIG. 20 is a flowchart (S20) illustrating a unit replacement detection process of detecting whether or not the toner cartridge has been replaced.

FIG. 20 is a flowchart (S20) illustrating a unit replacement detection process of detecting whether or not toner cartridge 52 has been replaced.

Figure 21:
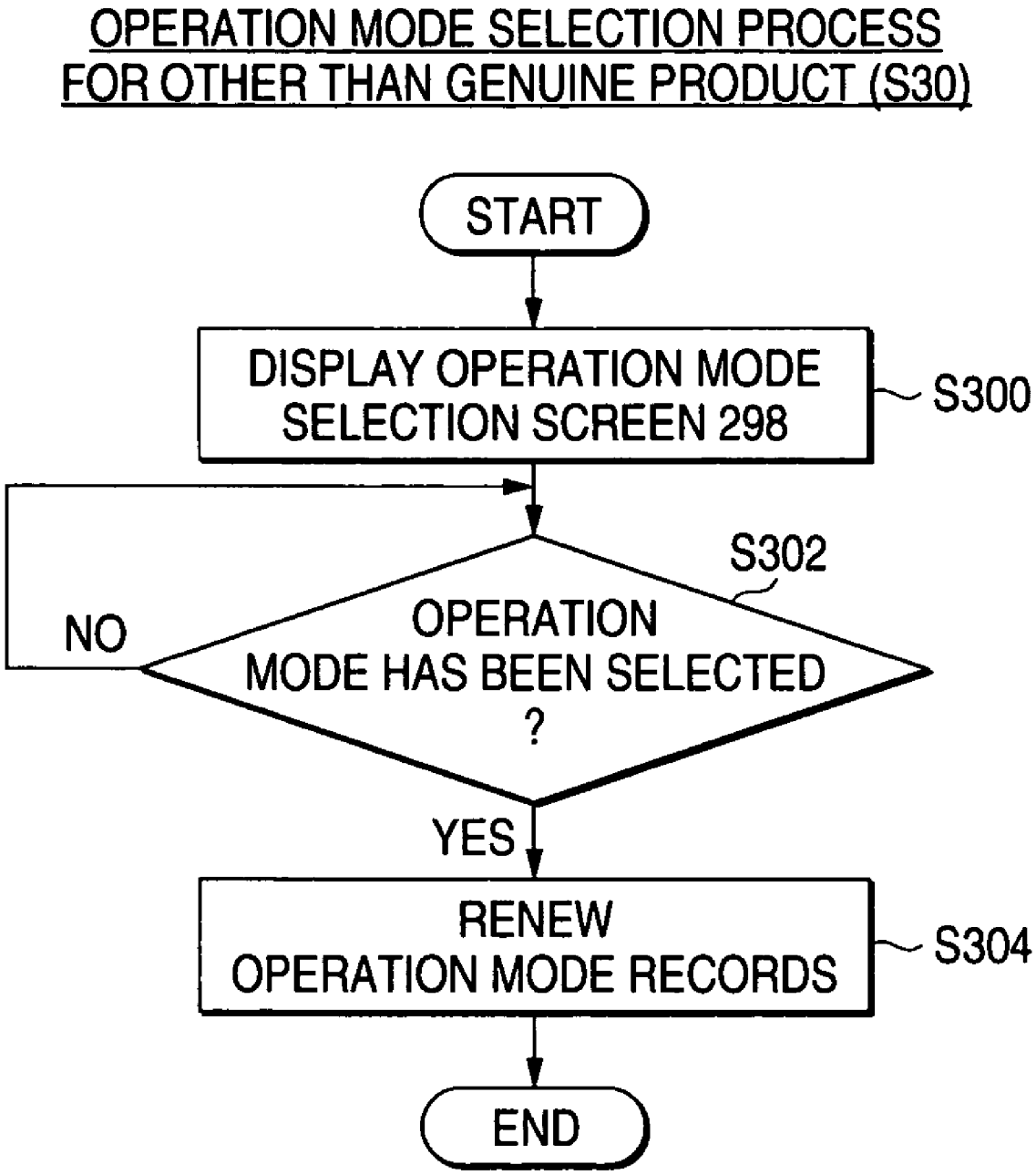
FIG. 21 is a flowchart (S30) illustrating an operation mode selection process that the image forming device carries out in regard to a product other than a genuine product for selection of an operation mode for a product other than a genuine product by a user.

FIG. 21 is a flowchart (S30) illustrating an operation mode selection process that image forming device 10 carries out in regard to a product other than a genuine product for selection of an operation mode for a product other than a genuine product by a user.

Figure 22:
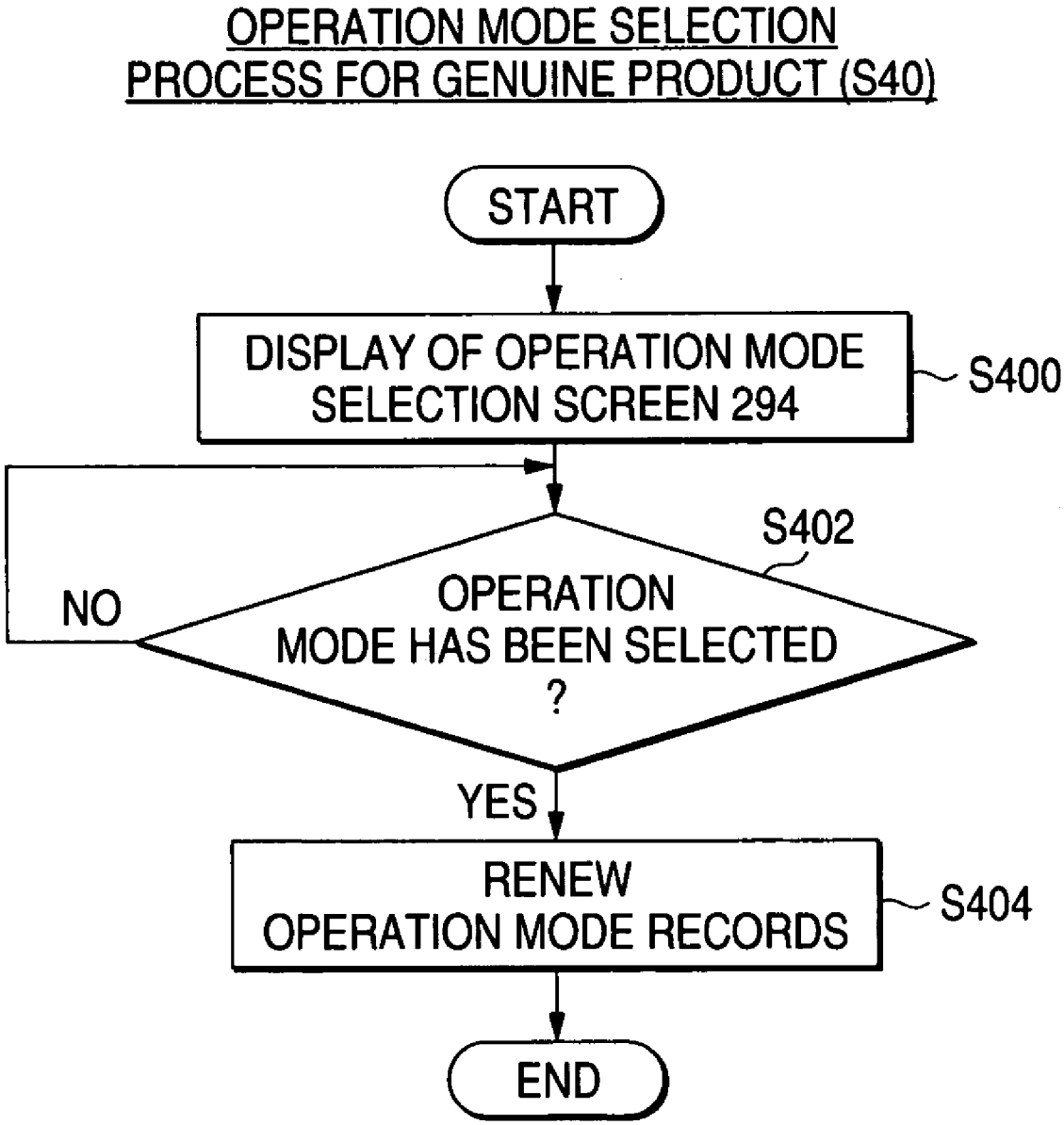
FIG. 22 is a flowchart (S40) illustrating an operation mode selection process that the image forming device carries out in regard to a genuine product for selection of an operation mode for a genuine product by a user.

FIG. 22 is a flowchart (S40) illustrating an operation mode selection process that image forming device 10 carries out in regard to a genuine product for selection of an operation mode for a genuine product by a user.

As shown in FIG. 19, in step 100 (S100), CPU 202 judges whether or not there has been an input for starting the selection of an operation mode by a user operating UI device 18. If there has been an input for starting the selection of an operation mode, the process of S30 is entered, while if there has not been an input for starting the selection of an operation mode, the process of S102 is entered.

In step 102 (S102), CPU 202 judges whether or not opening/closing detection sensor 19 has detected the opening/closing of opening/closing cover 16. If CPU 202 judges that the opening/closing of opening/closing cover 16 has been detected, the process of S20 is entered, and in other cases, the process of S100 is entered. That is, since when opening/closing cover 16 has been opened and closed, there is a possibility that toner cartridge 52 has been replaced, a unit replacement detection process is performed.

In step 200 (S200; FIG. 20), CPU 202 reads serial number 280 from unit NVM 184.

In step 202 (S202), CPU 202 reads the serial number of the toner cartridge that was mounted last, which is included in unit mounting records 262 in main body NVM 184.

In step 204 (S204), CPU 204 judges whether or not the serial number of the toner cartridge that was mounted last and serial number 280, read from unit NVM 184, are the same. If the serial number of the toner cartridge that was mounted last and serial number 280, read from unit NVM 184, are the same, the process of S206 is entered, and in other cases, the process of S208 is entered.

In step 206 (S206), CPU 202 deems that a toner cartridge 52 has been mounted again without being replaced (that replacement has not been performed).

In step 208 (S208), CPU 202 deems that a toner cartridge 52 has been mounted upon being replaced (that replacement has been detected).

In step 104 (S104; FIG. 19), if CPU 202 had deemed that the replacement of toner cartridge 52 has been detected, the process of S106 is entered, and in other cases, the process of S100 is entered.

In step 106 (S106), CPU 202 reads judging period setting value 252 from program ROM 224.

The value of judging period setting value 252 may be 0.

In step 108 (S108), CPU 202 judges, based on an unillustrated timer, etc., whether or not the judging timing has arrived for starting the judgment of whether the mounted toner cartridge 52 is a genuine product or a product other than a genuine product. If the judging timing, for starting the judgment between a genuine product and a product other than a genuine product, has arrived, the process of S110 is entered, and in other cases, CPU 202 waits until the judging timing arrives.

In step 110 (S110), CPU 202 reads model code 276 and country code 278 from unit NVM 184.

In step 112 (S112), CPU 202 reads supported model codes 258 and supported country codes 260 from main body NVM 228.

In step 114 (S114), CPU 202 collates model code 276 with supported model codes 258, collates country code 278 with supported country codes 260, and if it is judged that the replaced toner cartridge 52 is a genuine product, the process of S40 is entered while if it is judged that the replaced toner cartridge 52 is a product other than a genuine product, the process of S116 is entered.

In step 116 (S116), CPU 202 renews the mounting record of toner cartridge 52, which is included in unit mounting records 262 of main body NVM 228, in accordance with the data read from the presently mounted toner cartridge 52 and then enters the process of S30.

Figure 23A:
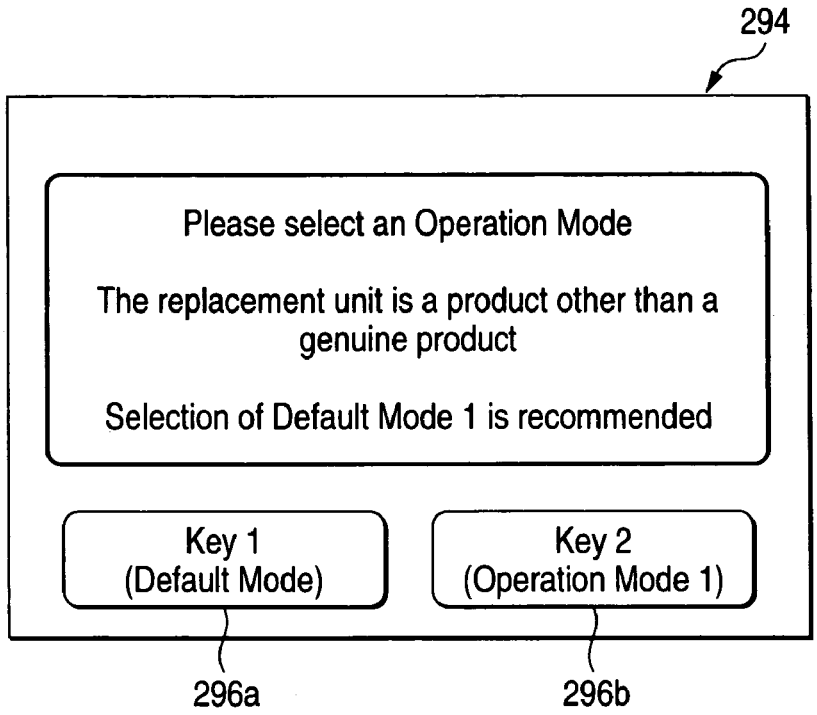
FIGS. 23A and 23B are diagrams showing, as examples, screens displayed on a UI device, with FIG. 23A showing a screen that accepts the input of a user's selection of an operation mode for a genuine product and FIG. 23B showing a screen that accepts the input of a user's selection of an operation mode for a product other than a genuine product.
Figure 23B:
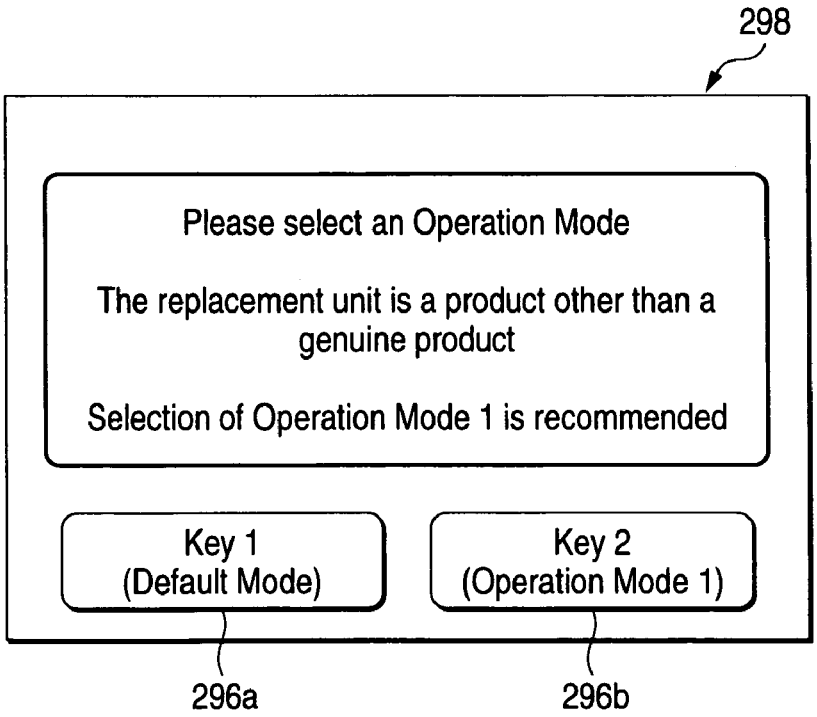

In step 300 (S300; FIG. 21), UI device 18 displays an operation mode selection screen 298, which is shown in FIG. 23B.

In step 302 (S302), CPU 202 judges whether or not an input, of selecting between a key button (key 1; default mode) 296*a* for selection of the default mode (operation mode accommodating a genuine product) and a key button (key 2; operation mode 1) 296*b* for designating another operation mode, which are displayed in operation mode selection screen 298, has been made. If an input selecting one of either key button 296*a* or 296*b* has been made, the process of S304 is entered, while if there is no input that designates either operation mode, image forming device 10 waits until a user selects an operation mode.

In step 304 (S304), CPU 202 performs renewal (including overwriting) of operation mode records 270 in main body NVM 228 with the operation mode selected in S302.

In step 400 (S400; FIG. 22), UI device 18 displays an operation mode selection screen 294, which is shown in FIG. 23A.

In step 402 (S402) CPU 202 judges whether or not an input, of selecting between a key button 296*a* for selection of the default mode (operation mode accommodating a genuine product) and a key button 296*b* for designating another operation mode, which are displayed in operation mode selection screen 294, has been made. If an input selecting one of either key button 296*a* or 296*b* has been made, the process of S404 is entered, while if there is no input that designates either operation mode, image forming device 10 waits until a user selects an operation mode.

In step 404 (S404), CPU 202 performs renewal (including overwriting) of operation mode records 270 in main body NVM 228 with the operation mode selected in S402.

In step 118 (S118; FIG. 19), CPU 202 carries out printing preparations in accordance with the selected operation mode that is contained in the most recent operation mode records 270 and ends the processes. In the printing preparations of S118, for example, that the mounted toner cartridge 52 is a genuine product or a product other than a genuine product may be made to be displayed on UI device 18.

Also, in regard to toner cartridge 52, arrangements may be made so that if in the process (S10) in which image forming device 10 carries out printing preparations in accordance with an operation mode, it is judged in the process of S114 that the replaced toner cartridge is a genuine product, the printing preparation process (S118) is entered without carrying out the operation mode selection process for a genuine product (S40).

Figure 24:
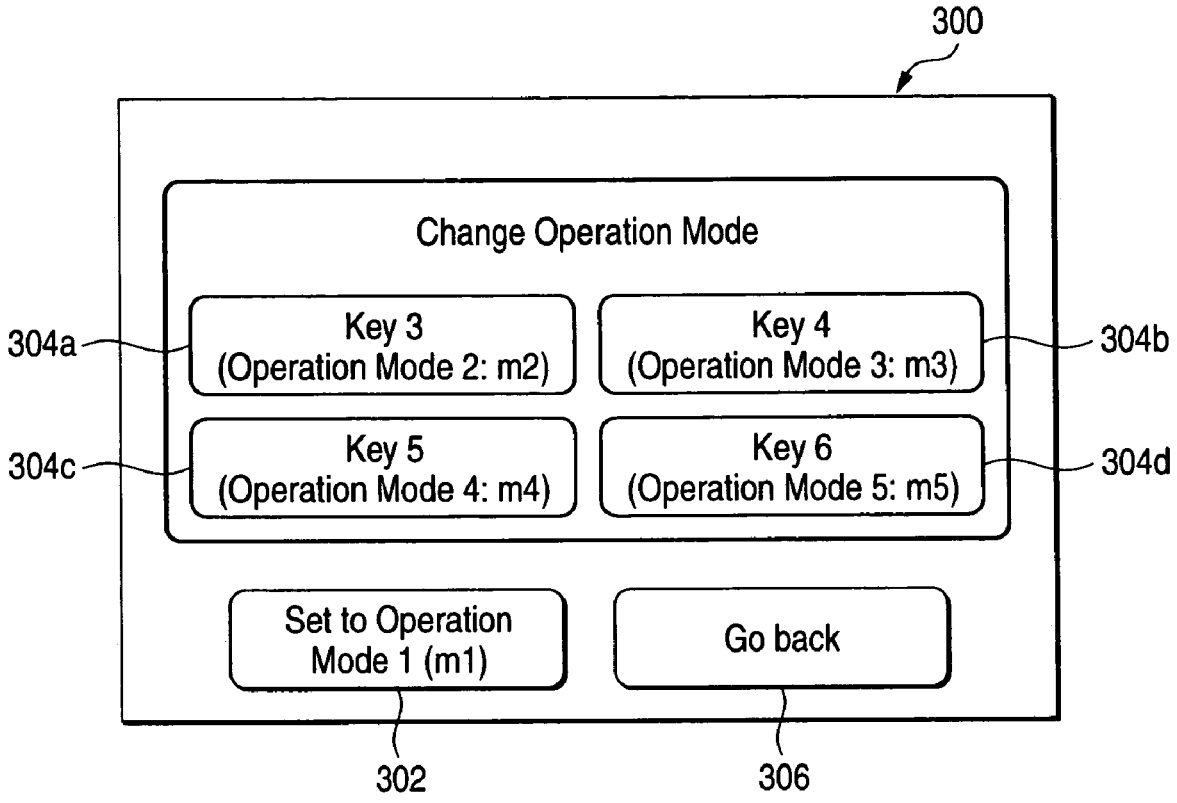
FIG. 24 is an operation mode confirmation/changing screen enabling a user to confirm that an operation mode, which is selected for a toner B, etc., that is a product other than a genuine product, will be set for the image forming device and to change to any of a plurality of other operation modes that differ from the operation mode accommodating a genuine product.

Also, arrangements may be made so that when the input of selecting key button (key 2; operation mode 1) 296*b* is made in operation mode selection screen 294 or 298, UI device 18 displays an operation mode confirmation/changing screen 300, which is shown in FIG. 24, to enable a user to confirm that an operation mode (m1; FIG. 18), which is selected for a toner B, etc., that is a product other than a genuine product, will be set for image forming device 10 and to change to any of a plurality of other operation modes that differ from the operation mode accommodating a genuine product. In operation mode confirmation/changing screen 300, key button 302 accepts the confirmation that the operation mode (m1) selected by the user is to be set for image forming device 10. Key buttons 304*a* to 304*d* are for indicating that there are a plurality of other operation modes (m2 to m5) besides the operation mode (m1) selected by the user that differ from the operation mode accommodating a genuine product and accepting the selection of a mode among the plurality of other operation modes (m2 to m5). Key button 306 indicates that either operation mode selection screen 294 or 298, which was displayed on UI device 18 prior to the display of operation mode confirmation/changing screen 300, can be displayed again and accepts the input for displaying either operation mode selection screen 294 or 298 again.

Figure 25:
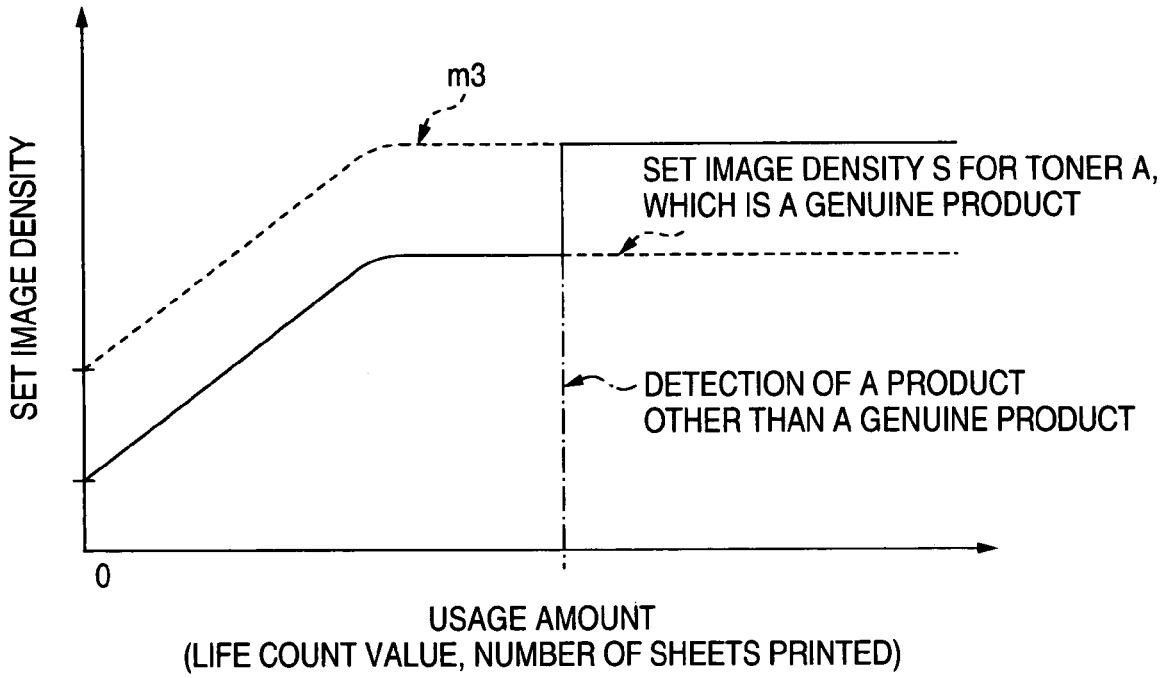
FIG. 25 is a graph showing set image density S in the case where the density of the image that is formed on the intermediate transfer body is corrected by the set image density until the judging timing arrives, and after it has been detected that toner cartridge is a product other than a genuine product, the operation mode is changed.

If judging timing setting value 252, which CPU 202 has read from program ROM 224, is not 0, even if, for example, the toner contained in toner cartridge 52 is not toner A, which is a genuine product, the density of the image formed by intermediate transfer body 74 is corrected by set image density S, which has been set in accordance with the characteristics of the genuine product toner A, until the judging timing arrives. If after the arrival of the judging timing, CPU 202 judges that the replaced toner cartridge 52 is a product other than a genuine product, since operation mode selection screen 298 is displayed, the user can select an operation mode that differs from the operation mode accommodating a genuine product. For example, as shown in FIG. 25, until the judging timing arrives, the density of the image that is formed on intermediate transfer body 74 is corrected by set image density S, and after it has been detected that toner cartridge 52 is a product other than a genuine product, the user can select an operation mode, such as operation mode (m3), etc., that differs from the operation mode accommodating a genuine product and change the set image density.

Arrangements are thus made so that even if a replaceable unit in image forming device 10 is a product other than a genuine product, the image quality can be improved by a user selecting an operation mode that differs from the operation mode accommodating a genuine product.

Also, in the case where all replaceable units are genuine products, the operation mode that can be selected by a user may be restricted so that image forming device 10 will operate only in the operation mode accommodating the genuine products and the user will be prevented from erroneously lowering the image quality.

As described above, image forming device 10 is provided with a plurality of replaceable units. Arrangements may be made so that in the case where at least one of these plurality of replaceable units is a product other than a genuine product, operation mode selection screen 298, etc., are displayed to enable selection of an operation mode.

Also, items that change in characteristics in accordance with the usage amount include, for example, intermediate transfer body 74, image carrying body 54, primary transfer roll 76, secondary transfer roll 88, and developing device 48, which contains the developer. With intermediate transfer body 74, surface degradation, flawing, attachment of an external additive, variation of resistance, etc., occur in accordance with the usage amount and the transfer efficiency changes. When flawing or attachment of an external additive, etc., occurs on intermediate transfer body 74, since the surface reflectance of intermediate transfer body 74 changes, the detection result of image density sensor 90 will also change in accordance with the usage amount. With image carrying body 54, wear, etc., occur in accordance with the usage amount. With primary transfer roll 76 and secondary transfer roll 88, variation of resistance, etc., occur in accordance with the usage amount. With developing device 48, which contains the developer, wear of developing roll 116, etc., occur in accordance with the usage amount. In the case of a single-component developer, wear, attachment of an external additive, for improvement of the charging property of the developer, etc., occur on developing roll 116 in accordance with the usage amount. Wear also occurs in accordance with the usage amount with layer thickness restricting member 124, etc., as well.

As ways by which control unit 106 performs correction or other form of control to make the toner concentration in developing device 48 be of a predetermined value for such items for which the characteristics change in accordance with the usage amount, besides changing the set image density of the image density of a toner density patch formed on intermediate transfer body 74, the set image density formed on intermediate transfer body 74 may be fixed and the developing bias applied to developing roll 116 and image carrying body 54 during development by developing device 48, the amount of exposure by exposure device 68, etc., may be changed to change the patch density.

Also as ways by which control unit 106 performs correction or other form of control to maintain the image density and other image quality characteristics of the image formed on paper be of predetermined levels, besides changing the set image density of the image density of the image density patch formed on intermediate transfer body 74, the set image density formed on intermediate transfer body 74 may be fixed and the developing bias applied to developing roll 116 and image carrying body 54 during development by developing device 48, the amount of exposure by exposure device 68, etc., may be changed to change the patch density.

Items, on which control unit 106 performs correction or other form of control to maintain the image quality characteristics of the image formed on paper be of predetermined levels, furthermore include the charging bias applied to charging roll 60, the transfer bias applied to primary transfer roll 76, and secondary transfer roll 88, the bias applied to scraper 94, etc.

Though it is difficult for a user to judge that the toner concentration in a developer is too high or too low, by providing the above-described arrangements, makers and sellers of products other than genuine products are enabled to search for conditions suited for the products other than genuine products in advance and indicate appropriate conditions to users.

Control of image forming device 10 in accordance with the environment shall now be described.

Figure 26:
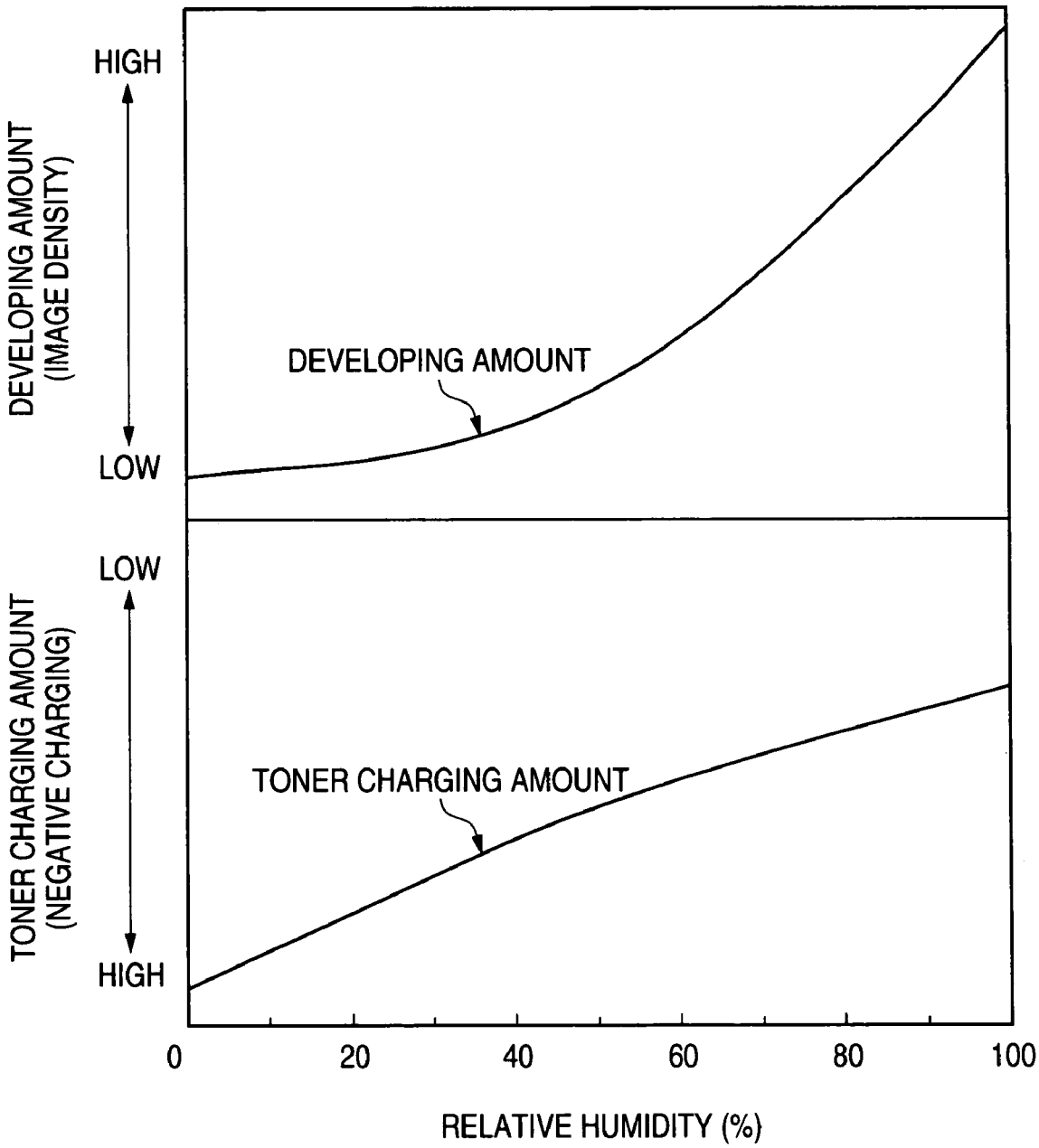
FIG. 26 is a graph showing the variation of the charging amount and the variation of the developing amount (image density) with respect to the variation of humidity (relative humidity) of a toner A, which is a genuine product.

FIG. 26 shows the variation of the charging amount and the variation of the developing amount (image density) with respect to the humidity (relative humidity) of toner A, which is a genuine product. When the toner concentration is fixed, the toner of a two-component developer, contained in developing device 48, changes in charging amount when the humidity, temperature, or other environmental condition changes. For example, when the humidity becomes high, the water absorption amount of the toner increases and the charging amount of the toner decreases (in the case of negative charging, the absolute value of a negative value decreases). When the charging amount of the toner decreases, the electrostatic adsorption force between the toner and the carrier weakens, the amount of developer that is transferred onto the electrostatic latent image on image carrying body 54 (developing amount) increases, and the density of the toner image (image density) that is carried on intermediate transfer body 74 becomes high. Meanwhile, when the humidity becomes low, the water absorption amount of the toner decreases and the charging amount of the toner increases (in the case of negative charging, the absolute value of a negative value increases). When the charging amount of the toner increases, the electrostatic adsorption force between the toner and the carrier strengthens, the amount of developer that is transferred onto the electrostatic latent image on image carrying body 54 decreases, and the density of the toner image that is carried on intermediate transfer body 74 becomes low.

In order to maintain the density of the image that is formed on paper at a predetermined level, image forming device 10 is arranged so that control unit 106 carries out a plurality of controls in accordance with the characteristics of the respective parts that make up image forming device 10. For example, image forming device 10 is arranged so that image density sensor 90 detects the density of a toner patch formed on intermediate transfer body 74 and CPU 202 of control unit 106 controls the rotation of first auger 118 and adjusts the amount of toner supplied to developing device 48 to maintain the charging amount of the toner in developing device 48 and thereby maintain the patch density in accordance with the detection result of image density sensor 90 (control of feeding back the image density detection result to toner density; image density control).

Figure 27:
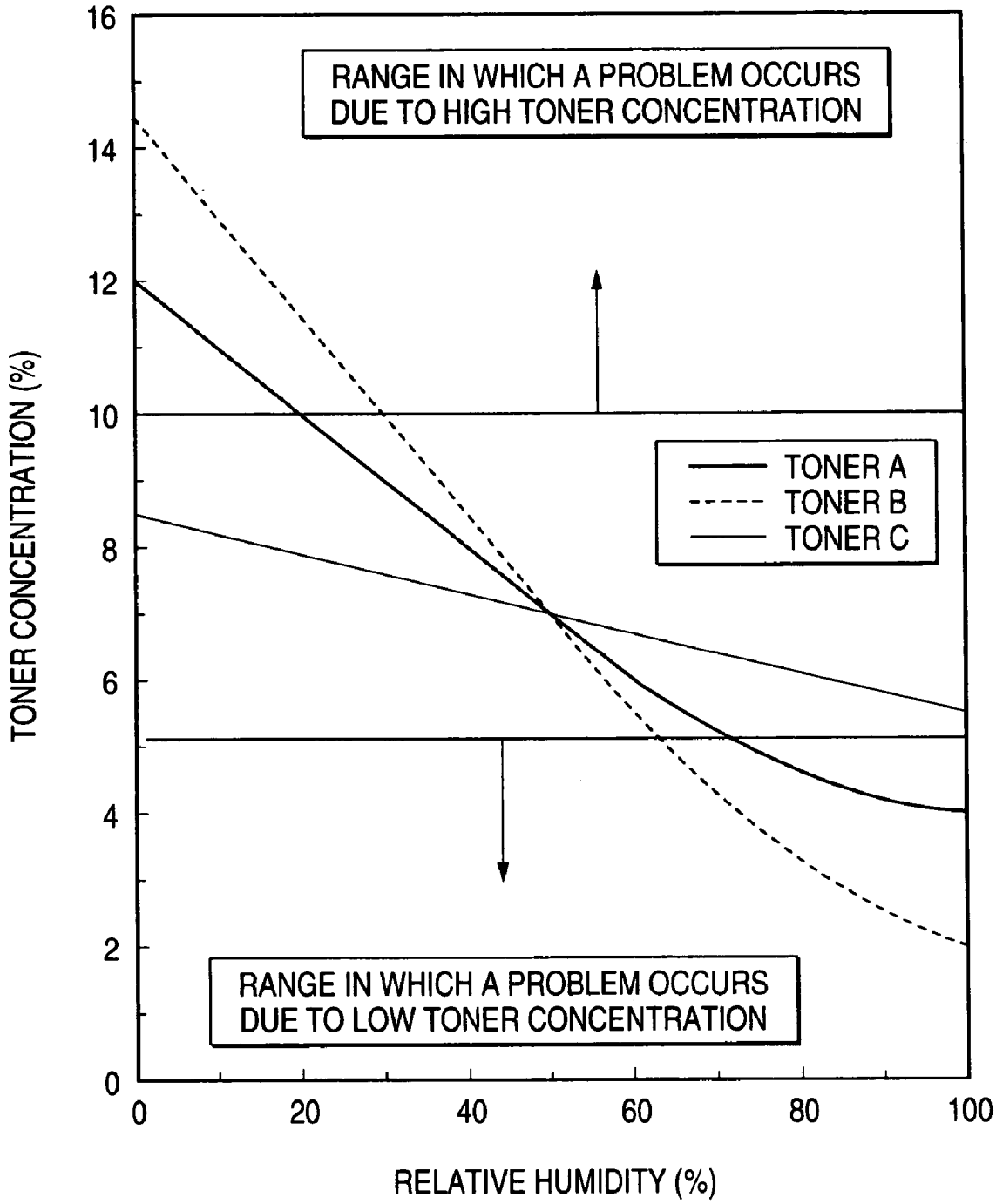
FIG. 27 is a graph showing the humidity characteristics of toner concentration under image density control.

FIG. 27 shows the humidity characteristics of the toner concentration resulting from image density control. As mentioned above, when the humidity (relative humidity) is low, the toner charging amount becomes high and the density of an image formed on intermediate transfer body 74 becomes low. When the density of an image formed on intermediate transfer body 74 becomes low, since by the control of feeding back the image density detection result to the toner concentration, CPU 202 increases the amount of toner supplied to developing device 48, when the humidity is low, the toner concentration becomes high. On the other hand, when the humidity (relative humidity) is high, the toner charging amount becomes low and the density of an image formed on intermediate transfer body 74 becomes high. Since, by the control of feeding back the image density detection result to the toner concentration, CPU 202 decreases the amount of toner supplied to developing device 48 when the density of an image formed on intermediate transfer body 74 becomes high, the toner concentration becomes low when the humidity is high.

With toner A, which is a genuine product, when the humidity falls below approximately 20%, toner A flies about inside image forming device main body 12 and causes soiling of the interior of image forming device main body 12 and other problems due to high toner concentration. Also, with toner A, when the humidity becomes higher than approximately 70%, lowering of the image transfer efficiency and other problems due to low toner concentration occur.

With toner B, which is a product other than a genuine product, by the control of feeding back the image density detection result to the toner concentration, the toner concentration changes more greatly with respect to a change in humidity in comparison to toner A. With toner C, which is a product other than a genuine product, even when the toner concentration is changed by the control of feeding back the image density detection result to the toner concentration, problems due to the toner concentration do not occur. Besides problems due to the toner concentration, toner C is, for example, poorer in regard to the cleaning of the toner remaining on image carrying body 54 than toner A and is thus regarded as a product other than a genuine product.

Figure 28:
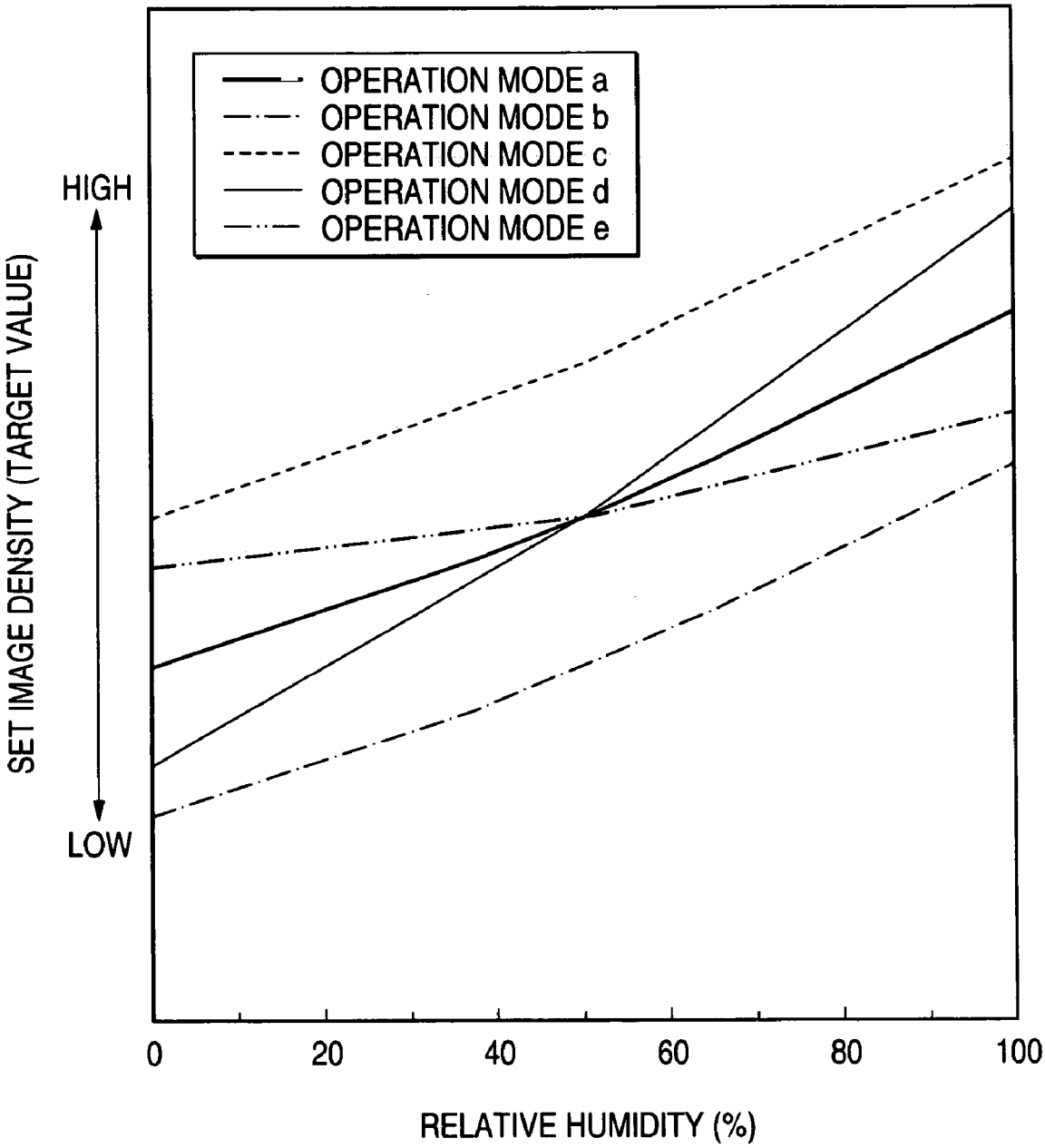
FIG. 28 is a graph showing the set image density (target value) with respect to the humidity (relative humidity).

FIG. 28 shows the set image density (target value) with respect to the humidity (relative humidity). With toner A, even when the control of feeding back the image density detection result to the toner concentration is performed, problems due to the toner concentration will not occur if corrections are made so that in a low humidity environment, the set image density (target value) is set to a low value so that the density of an image formed on intermediate transfer body 74 will be low and so that in a high humidity environment, the set image density (target value) is set to a high value so that the density of an image formed on intermediate transfer body 74 will be high. With image forming device 10, for toner A that is a genuine product, an operation mode a, with which the image density is corrected by making the set image density low in a low humidity environment and making the set image density high in a high humidity environment, is set as the default operation mode.

Also with image forming device 10, in addition to operation mode a (default mode), a plurality of other operation modes are provided for products other than genuine products. For example, image forming device 10 is provided with an operation mode b, with which the initial value of the set image density is lowered in comparison to operation mode a, an operation mode c, with which the initial value of the set image density is raised in comparison to operation mode a, an operation mode d, in which the slope of the set image density with respect to humidity is made large, and an operation mode e, in which the slope of the set image density with respect to humidity is made small, and a user is enabled to make a selection from among these operation modes. An operation mode, with which the set image density is not changed with a change in humidity (the slope with respect to humidity is set to 0), may also be provided.

Figure 29:
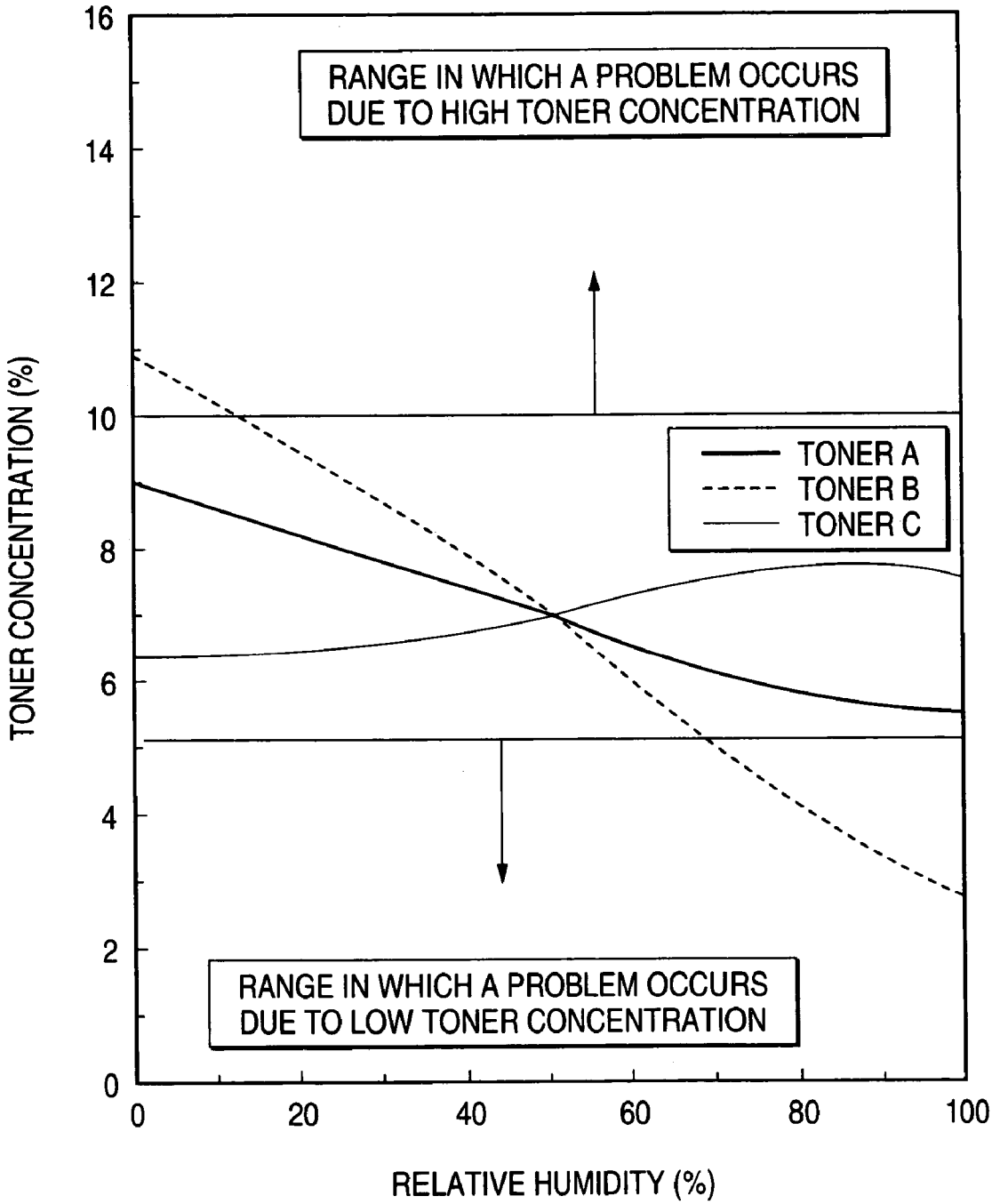
FIG. 29 is a graph showing the toner concentrations of toners A, B, and C with respect to humidity (relative humidity) in cases where image density control, corrected in accordance with operation mode a, is performed.
Figure 30A:
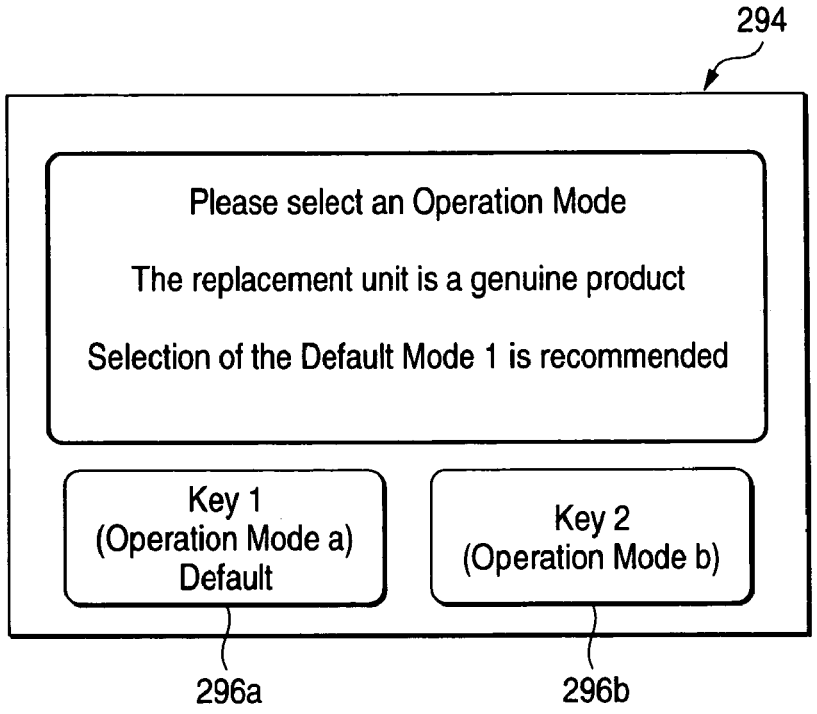
FIGS. 30A and 30B are diagrams showing, as examples, screens displayed on a UI device, with FIG. 30A showing a screen that accepts the input of a user's selection of an operation mode for a genuine product and FIG. 30B showing a screen that accepts the input of a user's selection of an operation mode for a product other than a genuine product.
Figure 30B:
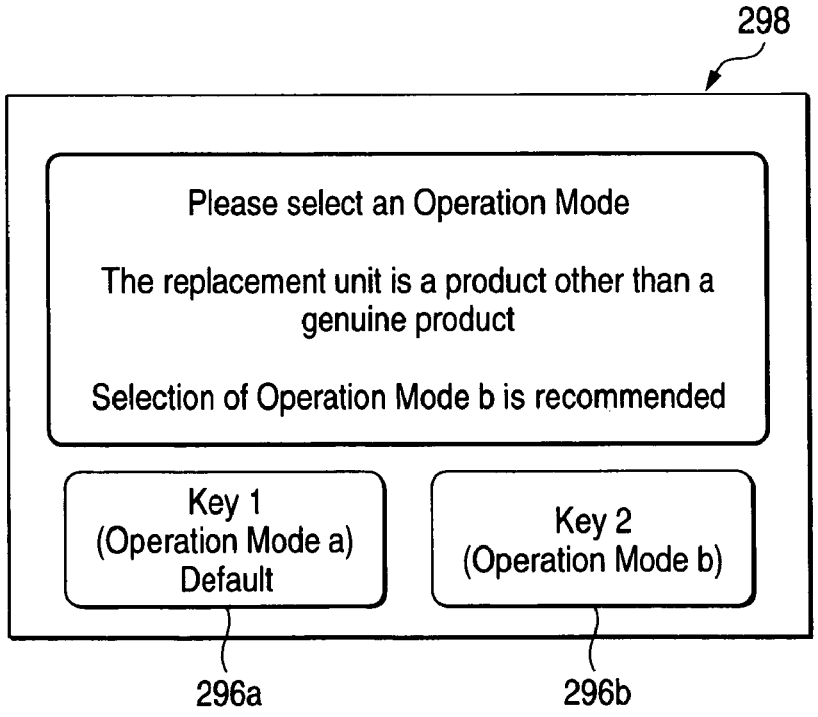

FIG. 29 shows the toner concentrations of toners A, B, and C with respect to humidity (relative humidity) in cases where image density control, corrected in accordance with operation mode a, is performed.

With toner A, when operation mode a is selected, the variation of toner concentration of toner A with respect to humidity falls within a range in which a problem will not occur. With toner B, even when operation mode a is selected, the variation of toner concentration of toner B with respect to humidity cannot be restrained within a range in which a problem will not occur. Here, if for example, operation mode d is selected by a user, the variation of toner concentration of toner B with respect to humidity will fall within a range in which a problem will not occur. Also, with toner C, when operation mode a is selected, the toner concentration becomes high under high humidity, the toner concentration becomes low under low humidity, and there is a range in which the variation of toner concentration with respect to the variation of humidity becomes large. Thus by a user selecting an operation mode in accordance with the type of toner, problems due to the toner concentration can be prevented while maintaining the density of an image formed on paper at a predetermined level.

The density of an image formed on intermediate transfer body 74 may be adjusted by a method that differs from the control of the rotation of first auger 118, that is, for example, by control of the exposure amount of exposure device 68, etc., in accordance with a user's selection.

Operation modes that differ from the operation mode accommodating genuine products may also be arranged by combining the image density setting with the settings of other parameters, etc.

Also, in the case where an operation mode other than operation mode a, which is the default operation mode, is selected, UI device 18 displays an indication that the operation of image forming device 10, the image quality, and the reliability cannot be guaranteed. Furthermore, by operation of UI device 18, the indication that the reliability, etc., cannot be guaranteed may be made not to be displayed.

Also, in regard to toner cartridge 52, arrangements may be made so that if in the process (S10) in which image forming device 10 carries out printing preparations in accordance with an operation mode, it is judged in the process of S114 that the replaced toner cartridge is a genuine product, the printing preparation process (S118) is entered without carrying out the operation mode selection process for a genuine product (S40).

Figure 31:
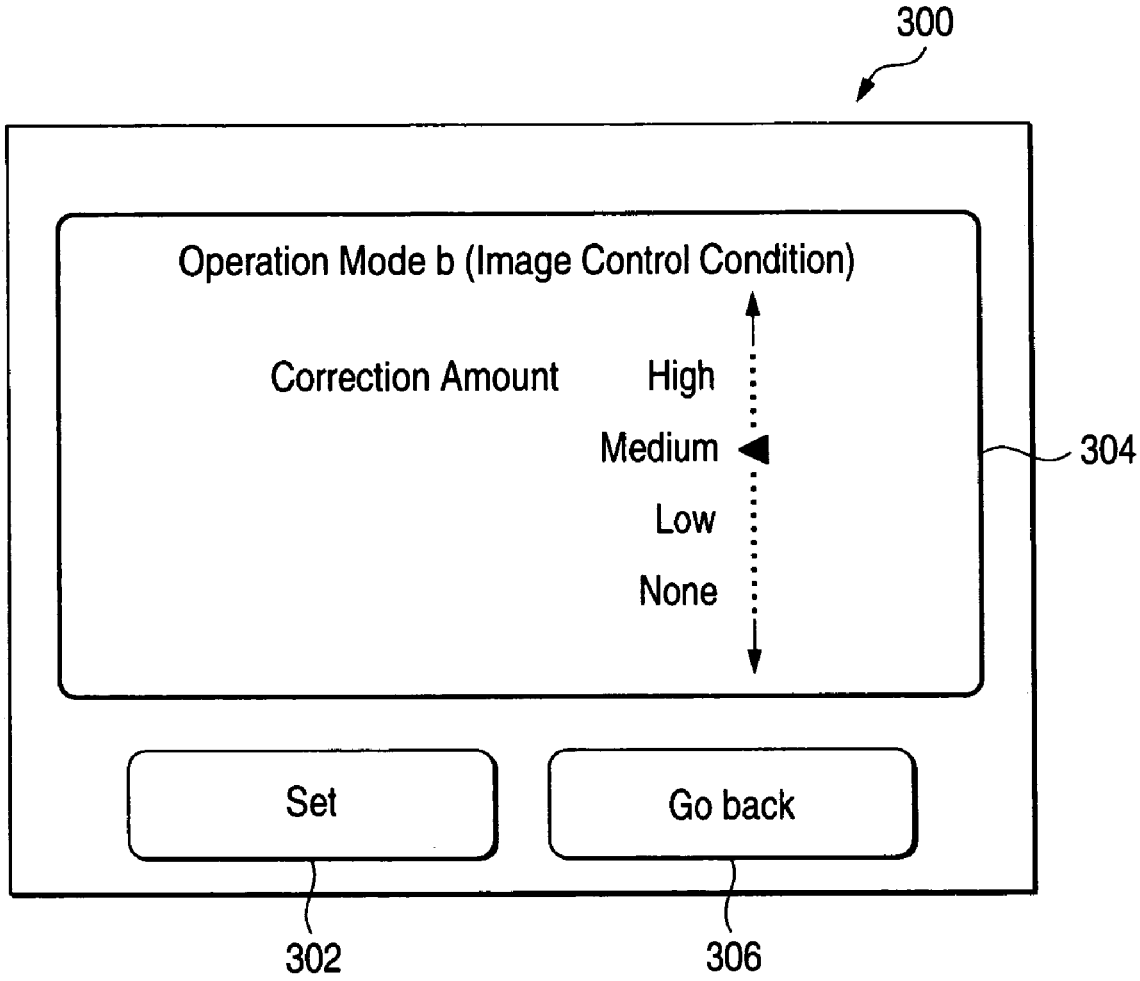
FIG. 31 is an operation mode confirmation/changing screen for enabling confirmation that an operation mode b, which is selected for a toner B, etc., that is a product other than a genuine product, will be set for the image forming device and enabling further adjustment of the correction amount in operation mode b.

Arrangements may be made so that when the input of selecting key button (key 2; operation mode b) 296*b* is made in operation mode selection screen 294 or 298, UI device 18 displays an operation mode confirmation/changing screen 300, which is shown in FIG. 31, to enable confirmation that an operation mode b, which is selected for a toner B, etc., that is a product other than a genuine product, will be set for image forming device 10 and enable further adjustment of the correction amount in operation mode b. In operation mode confirmation/changing screen 300, key button 302 accepts the confirmation that operation mode b, selected by the user, is to be set for image forming device 10. Adjustment part 304 displays that the correction amount of operation mode b, which has been selected by the user, can be adjusted, for example, among the four levels of high, medium, low, and none, and accepts the selection of adjustment of the correction amount. Key button 306 indicates that either operation mode selection screen 294 or 298, which was displayed on UI device 18 prior to the display of operation mode confirmation/changing screen 300, can be displayed again and accepts the input for displaying either operation mode selection screen 294 or 298 again.

Figure 32:
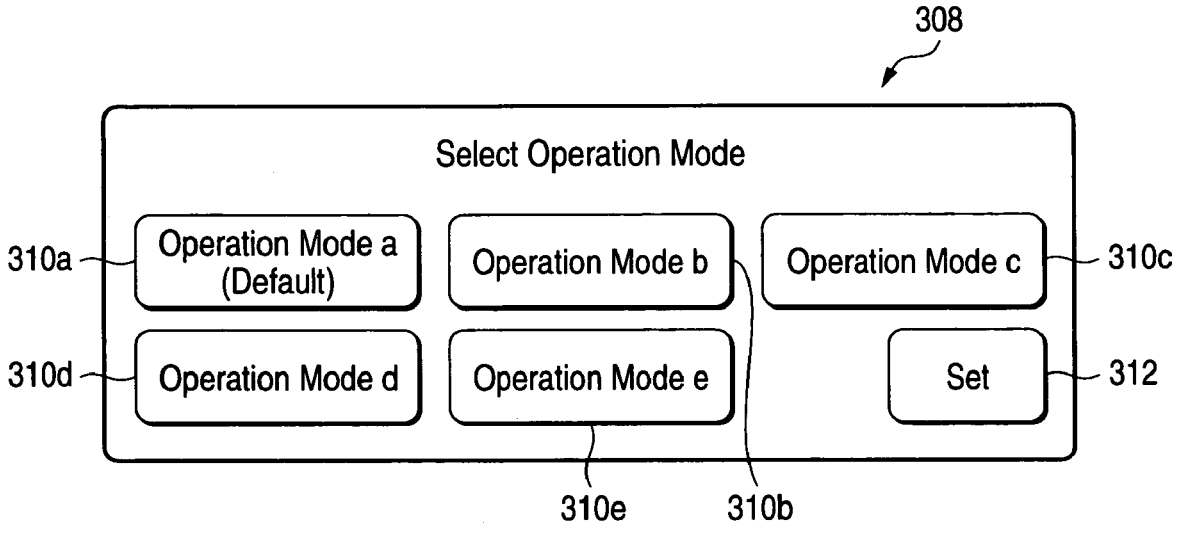
FIG. 32 is an operation mode selection screen enabling selection of an operation mode from among operation mode a, which is the default, and other operation modes b, c, d, and e.

Also in place of operation mode selection screens 294 and 298, an operation mode selection screen 308, shown in FIG. 32, may be displayed to enable selection of an operation mode from among operation mode a, which is the default, and other operation modes b, c, d, and e. In operation mode selection screen 308, key button 310*a* accepts the confirmation that a user is setting the default operation mode a for image forming device 10. Key buttons 310*b, c, d*, and *e* indicate that the user can select any of operation modes b, c, d, and e and accepts the user's selection of any of operation modes b, c, d, and e. Key button 312 accepts the setting of image forming device 10 to the selected operation mode among operation modes b, c, d, and e.

Arrangements are thus made so that even if a replaceable unit in image forming device 10 is a product other than a genuine product, the image quality can be improved by a user selecting an operation mode that differs from the operation mode accommodating a genuine product.

Also, in the case where all replaceable units are genuine products, the operation mode that can be selected by a user may be restricted so that image forming device 10 will operate only in the operation mode accommodating the genuine products and the user will be prevented from erroneously lowering the image quality.

As described above, image forming device 10 is provided with a plurality of replaceable units. Arrangements may be made so that in the case where at least one of these plurality of replaceable units is a product other than a genuine product, operation mode selection screen 298, etc., are displayed to enable selection of an operation mode.

Also, items that change in characteristics in accordance with humidity, temperature, or other aspect of the environment of the location at which image forming device 10 is positioned or the environment inside image forming device main body 12 include, for example, intermediate transfer body 74, image carrying body 54, primary transfer roll 76, secondary transfer roll 88, and developing device 48, which contains the developer. With intermediate transfer body 74, resistance variations, etc., occur and the transfer efficiency changes in accordance with the environment. With image carrying body 54, the variation of the sensitivity with respect to the exposure amount, etc., occur in accordance with the environment. With primary transfer roll 76 and secondary transfer roll 88, variation of resistance, etc., occur in accordance with the environment. With charging device 60, variation of resistance, etc., occur in accordance with the environment.

Besides the density of an image formed on intermediate transfer body 74, parameters, by which control unit 106 performs correction or other form of control on such items that change in characteristics in accordance with the environment in order to maintain the image quality of images formed on paper, etc., at predetermined levels, include, for example, the toner concentration (set toner concentration) set for the toner inside developing device 48, the developing bias applied to developing roll 116 and image carrying body 54 during development by developing device 48, the transfer bias applied to primary transfer roll 76 and secondary transfer roll 88, the amount of exposure by exposure device 68, etc. This is because, due to the toner being charged, the image quality of images formed on paper, the cleaning properties of image carrying body 54 and intermediate transfer body 74, etc., are controlled in accordance with the characteristics of the respective parts that make up image forming device 10.

What is claimed is:

1. An image forming device comprising:

a main device body;

at least one replacement unit, mounted replaceably to the main device body;

a judging unit, judging whether the replacement unit is a genuine product or is a product other than a genuine product;

an input unit, for selecting among an operation mode, corresponding to a replacement unit that is a genuine product, and other operation modes that differ from the operation mode, corresponding to a replacement unit that is other than a genuine product and improving an image quality achieved with the replacement unit;

a correction unit, correcting image forming conditions in accordance with usage amounts related to image formation; and a correction amount changing unit, changing the amounts of correction by the correction unit in accordance with the operation mode selected by the input unit.

2. The image forming device according to claim 1, wherein the correction amount changing unit comprises at least one among an initial setting value changing unit, changing initial setting values of the image forming conditions corrected by the correction unit, and a correction amount zeroing unit, making the amounts of correction of the image forming conditions by the correction unit substantially zero.

3. The image forming device according to claim 1, wherein the operation mode, accommodating a replacement unit that is a genuine product, is set as a default.

4. The image forming device according to claim 1, further comprising:

a detection unit, detecting that the replacement unit has been replaced; and wherein the correction amount changing unit changes the amounts of correction by the correction unit in accordance with the operation mode selected by the input unit when the detection unit detects that the replacement unit has been replaced.

5. The image forming device according to claim 4, wherein the detection unit detects that the replacement unit has been replaced at a predetermined timing after the replacement unit has been replaced.

6. The image forming device according to claim 1, wherein when the judging unit judges that at least one of the replacement units is a product other than a genuine product, the correction amount changing unit changes the amounts of correction by the correction unit in accordance with the operation mode selected by the input unit.

7. An image forming device comprising:

a main device body;

at least one replacement unit, mounted replaceably to the main device body;

a judging unit, judging whether the replacement unit is a genuine product or is a product other than a genuine product;

an input unit, for selecting among an operation mode, accommodating a replacement unit that is a genuine product, and other operations mode that differ from the operation mode;

a detection unit, detecting the environment;

a correction unit, correcting image forming conditions in accordance with detection results of the detection unit; and a correction amount changing unit, changing the amounts of correction by the correction unit in accordance with the operation mode selected by the input unit.

8. The image forming device according to claim 7, wherein the correction amount changing unit comprises at least one among an initial setting value changing unit, changing initial setting values of the image forming conditions corrected by the correction unit, and a correction amount zeroing unit, making the amounts of correction of the image forming conditions by the correction unit substantially zero.

9. The image forming device according to claim 7, wherein the operation mode, accommodating a replacement unit that is a genuine product, is set as a default.

10. The image forming device according to claim 7, further comprising:

a replacement detection unit, detecting that the replacement unit has been replaced; and wherein the correction amount changing unit changes the amounts of correction by the correction unit in accordance with the operation mode selected by the input unit when the replacement detection unit detects that the replacement unit has been replaced.

11. The image forming device according to claim 10, wherein the replacement detection unit detects that the replacement unit has been replaced at a predetermined timing after the replacement unit has been replaced.

12. The image forming device according to claim 7, wherein when the judging unit judges that at least one of the replacement units is a product other than a genuine product, the correction amount changing unit changes the amounts of correction by the correction unit in accordance with the operation mode selected by the input unit.

13. The image forming device according to claim 1, wherein the input unit allows a user to select among the operation mode and the other operation modes.

* * * * *